US007175365B1

(12) United States Patent
Breeding

(10) Patent No.: US 7,175,365 B1
(45) Date of Patent: Feb. 13, 2007

(54) PORTABLE VIBRATORY CONCRETE SCREED

(76) Inventor: Kenny G Breeding, 10922 Garrison Rd., Little Rock, AR (US) 72223

( * ) Notice: Subject to any disclaimer, the term of this patent is extended or adjusted under 35 U.S.C. 154(b) by 0 days.

(21) Appl. No.: 10/753,299

(22) Filed: Jan. 7, 2004

Related U.S. Application Data

(60) Provisional application No. 60/438,701, filed on Jan. 7, 2003.

(51) Int. Cl.
*E01C 19/38* (2006.01)
*E01C 19/22* (2006.01)

(52) U.S. Cl. ..... 404/113; 404/114; 404/118; 404/119

(58) Field of Classification Search ..... 404/75, 404/100, 101, 113, 114, 118–120
See application file for complete search history.

(56) References Cited

U.S. PATENT DOCUMENTS

| | | | | |
|---|---|---|---|---|
| 1,955,101 | A | 4/1934 | Sloan | |
| 4,386,901 | A | 6/1983 | Morrison | |
| 4,641,995 | A | 2/1987 | Owens | |
| 4,838,730 | A | 6/1989 | Owens | |
| 5,244,305 | A | 9/1993 | Lindley | |
| 5,375,942 | A | 12/1994 | Lindley | |
| 5,857,803 | A * | 1/1999 | Davis et al. | 404/102 |
| 5,984,571 | A | 11/1999 | Owens | |
| 6,089,787 | A * | 7/2000 | Allen et al. | 404/118 |
| 6,200,065 | B1 * | 3/2001 | Eitzen | 404/114 |
| 6,296,467 | B1 * | 10/2001 | Rouillard | 425/182 |
| 6,976,805 | B2 * | 12/2005 | Quenzi et al. | 404/114 |
| 6,988,851 | B2 * | 1/2006 | Sina | 404/114 |
| 2005/0100407 | A1 * | 5/2005 | Sina | 404/114 |

* cited by examiner

*Primary Examiner*—Raymond Addie

(57) ABSTRACT

A portable vibratory concrete screed is described. The screed includes a screed blade including a flat bottom surface extending between a front edge of the screed blade and a rear edge of the screed blade. The screed also includes a vibrator cartridge assembly, with an eccentric weight, releasably coupled to the screed blade. The blade assembly is capable of receiving many different blade styles. The screed includes a handle assembly extending from both sides of the vibratory assembly. The handle assembly includes adjustable and lockable grips.

9 Claims, 34 Drawing Sheets

PORTABLE VIBRATORY CONCRETE SCREED

CROSS-REFERENCE TO RELATED APPLICATIONS

This application claims benefit of provisional application No. 60/438,701 filed Jan. 7, 2003.

FEDERALLY SPONSORED RESEARCH OR DEVELOPMENT

Not Applicable

BACKGROUND OF THE INVENTION

1. Field of the Invention

As is known, the usage of concrete as a building material is widespread and ever growing, where, although various mechanical finishing approaches are already available, striking and/or grading primarily remains a hand-operation.

A typical procedure employed in connection with the placing of concrete involves strike-off; bull float, as for rock wash down; and, finally, hand-finishing, typically involving the use of trowels. The preceding is time consuming and, therefore, a need has arisen for more rapidly completing the latter but, at the same time, with professional quality results.

The present invention relates to devices for surfacing concrete and, more particularly, to vibrating screeds for concrete surfacing of the type having an elongated blade mounted transversally at the bottom of a pair of hand held handles with a motor being adapted to transmit to the blade a vibratory movement.

2. Description of the Prior Art

Conventional vibrating screeds comprise, for instance, an elongated blade extending horizontally and transversally at lower ends of a pair of handles adapted to be hand held and operated for displacing the screed over a concrete surface. A motor is provided above the blade and between the handles and has its shaft extending vertically downwards from the motor to the blade and is connected thereat such that, with a counterweight or a cam-like arrangement, it imparts oscillatory movement to the blade of high frequency but low amplitude.

The pair of handles permit an easy and constant correction of the level of the concrete with minimum effort. The blade may have different lengths, for example between 4 and 12 feet. A throttle control of the motor is provided at one of the handles such that the speed of the motor may be monitored and adjusted as the blade is displaced over the concrete being surfaced.

Numerous screeds employ vibratory action to tamp and smooth concrete in the final finishing step. U.S. Pat. No. 4,340,351 describes a vibratory concrete screed used in the final finishing of concrete. This screed requires two operators. U.S. Pat. No. 4,641,995 describes a vibratory concrete screed, which rides on forms to screed narrow strips of concrete, such as walks. This screed is mounted on the operator via a complicated harness counter-weighted frame and is powered by electricity. As a result, the screed requires electrical power on site and the screed requires manipulation of lengthy extension cords.

Escalating labor costs and the unavailability of qualified concrete helpers have pushed the concrete finishers' profitability margin down continually, thus forcing rising costs of construction nationwide. The current standard method of wet screeding freshly poured concrete is with a 2" by 4" board 8' to 20' long with one or two men hand working the concrete all day long as two to four laborers, "puddlers", push the fresh concrete, "mud", in place with concrete rakes.

The hand process is not only slow, inefficient and labor intensive, it is also often requires the addition of more water to the concrete mix to make it more workable. The additional water reduces the strength of the concrete, causing voids and weak spots. The addition of water to produce slumps of 6" to 8", so the finisher can effectively hand "Wet Screed" the fresh concrete, is common in the industry nationwide today. The hand process limits the finisher to the average pour of 6,000 to a maximum of 8,000 square feet of slab per day for a crew of six.

It is known in the art to provide rotatable handles and telescoping arms, for example U.S. Pat. No. 6,296,467. These devices provide only a limited range of adjustment and are clumsy to operate. The adjustment settings frequently change due to the constant vibrations inherent in portable vibrating screeds. These changes cause operator discomfort and require the operator to stop work to make the necessary corrections before continuing on the work site. Other prior art devices have folding handle bars that simply fold in or down and up. They remain mainly rigid and require considerable space for transportation or storage.

In all current production models of portable vibrating screeds, the vibrator in an integral part of the housing that is built in or is permanently attached to the blade adapter. The unit must be completely disassembled during the routine maintenance required for all vibrational tools of this type. This only increases the down time of the screed and the operator thereby, increasing costs.

Extruded L-shaped screed blades are known in the art. Many of the blades are thin, tapered and elongated blades that are flexible over the lengths common is these free floating screeds. Many do not transmit the vibrational energy in a uniform manner over the entire length of the blade.

All prior art portable vibrating screeds have the power unit permanently mounted to a specific screed blade adapter, which is used to attach to a specific screed blade style or shape. Multiple screeds are necessary for an operator to obtain the benefit of a particular screed blade style or shape in specific applications. For instance, a particular job site may present conditions where a triangular shaped blade would be more efficient than an L-shaped blade.

It is, therefore, an object of the present invention to provide a portable vibratory concrete screed. The concrete screed includes a screed blade including a flat bottom surface extending between a front edge of the screed blade and a rear edge of the screed blade. The screed also includes a vibrator cartridge assembly, with an eccentric weight, releasably coupled to the screed blade. Further, the screed includes an adjustable handle bar assembly extending from the power housing assembly and coupling a motor to the power platform assembly which drives the vibrator cartridge assembly thereby rotating the eccentric weight and vibrating the screed blade.

It is another object of the present invention to provide a portable vibratory concrete screed wherein the vibrator cartridge assembly includes a drive shaft upon which the eccentric weight is mounted.

It is a further object of the present invention to provide a portable vibratory concrete screed including a screed blade mounting assembly coupling the vibrator cartridge assembly to the screed blade.

It is also an object of the present invention to provide a portable vibratory concrete screed wherein the screed blade mounting assembly includes a mounting bracket supporting the vibrator cartridge assembly above the screed blade.

It is another object of the present invention to provide a portable vibratory concrete screed wherein the handle bar assembly is coupled to the power platform assembly, and vibration isolators are positioned between the handle bar assembly and the blade adapter assembly to lessen vibrations transmitted to a user.

It is another object of the present invention to provide a portable vibratory concrete screed wherein the handle bar assembly is compounded in folding capability and capable of bilateral axis movements yielding virtually any position for operator height and comfort coupled to the power platform assembly, and vibration isolators are positioned between the handle bar assembly and the blade adapter assembly to lessen vibrations transmitted to a user.

It is a further object of the present invention to provide a portable vibratory concrete screed wherein the handle bar assembly is coupled to the power platform assembly, and the power platform assembly has an integral handle for lifting and carrying the screed It is also an object of the present invention to provide a portable vibratory concrete screed wherein the vibratory assembly includes an end cap secured to the vibration cartridge assembly to encase the eccentric weight.

It is another object of the present invention to provide a portable vibratory concrete screed wherein the vibrator cartridge assembly includes at least one bearing on the drive shaft to lessen vibrations.

It is another object of the present invention to provide a portable vibratory concrete screed wherein the vibrator cartridge assembly easily removable for quick replacement and repair to reduce downtime to the screed operator.

It is another object of the present invention to provide a portable vibratory concrete screed wherein the vibrator cartridge assembly easily removable for quick replacement and repair.

It is another object of the present invention to provide a portable vibratory concrete screed wherein the vibrator cartridge assembly simply requires removing the bolts and bearing cartridge, replace the cartridge with a new or rebuilt cartridge, attach the unbalanced weights and continue on the job site.

It is a further object of the present invention to provide a portable vibratory concrete screed wherein the motor is secured to the power platform assembly at distal end of the handle bar assembly.

It is also an object of the present invention to provide a portable vibratory concrete screed wherein the handle bar assembly includes an adjustable handle grip tube.

It is also an object of the present invention to provide a portable vibratory concrete screed wherein an exact pin locking system for holding the handle grip tubes in an angular position that stays locked in place while being subjected to the inherent vibrational forces generated during concrete screeding.

It is also an object of the present invention to provide a portable vibratory concrete screed wherein the adjustable handle grip tube is secured in position by a plurality of set pins.

It is another object of the present invention to provide a portable vibratory concrete screed wherein the handle grip tube is adjustable to suit users of different heights.

It is another object of the present invention to provide a portable vibratory concrete screed wherein the handle bar assembly is adjustable along the mid point for adjustment to suit users of different heights.

It is another object of the present invention to provide a portable vibratory concrete screed wherein the handle bar assembly contains a kick stand along the mid point for supporting the screed.

It is also an object of the present invention to provide a portable vibratory concrete screed wherein the handle bar assembly folds over the motor for transportation and storage.

It is a further object of the present invention to provide a portable vibratory concrete screed wherein the screed blade has an L-shaped cross section containing structural gussets for strength and vibration transmission.

It is also an object of the present invention to provide a portable vibratory concrete screed wherein the screed blade adapter assembly is capable of receiving many different blade shapes.

It is also an object of the present invention to provide a portable vibratory concrete screed wherein the screed blade adapter assembly is capable of receiving many different blade styles.

The present invention allows the wet screeding of concrete quickly and efficiently with only one operator and two puddlers, while doubling the potential daily pour to 13,000 to 16,000 square feet per day; literally as fast as the concrete trucks can pour it. The increased efficiency also doubles the income potential of the concrete finisher. Simultaneously, the present screed, with its floating vibratory action, produces a much higher quality slab having greater strength, no voids and no weak spots. The present screed also allows one additional hour for final finishing by working the rock down and bringing the fat to the surface.

In addition to doubling the potential surface area that may be efficiently wet screeded each day, the present screed's light weight portability and single operator ease of operation reduces the required crew size from the six (6) workers normally required with conventional hand wet screeding methods to four (4) workers.

Even doubling the area of production, the crew and operator of the present screed are vastly less physically fatigued at days end due to the ease of operation of the invention and its efficient high quality work. This is one of the most valuable benefits of the invention since it is directly beneficial to the health and well being of both operator and crew.

Additionally, due to the invention's light weight an operator can when required, utilize the device as a bull float temporarily, with the power vibratory action on idle, to smooth out a spot or two inadvertently missed by the operator.

Further, due to the interchangeability design of the screed blade, the present screed may be used as a straight edge to check the flatness of the slab after the slab has been powered troweled. With the power vibratory action on idle, the screed can be pulled along the surface of the slab. If a hump or bump is detected (by vibrations at the screed blade), the operator pushes the present screed back, applies a little throttle, and the sharp cutting edge of the screed blade will cut through and peel the bump off the surface of the slab.

Other objects and advantages of the present invention will become apparent from the following detailed description when viewed in conjunction with the accompanying drawings, which set forth certain embodiments of the invention.

In view of the shortcomings of hand processing wet concrete and prior art vibratory screeds, a need exists for a portable vibrating screed which effectively and efficiently prepares wet concrete for use. The need exists for a screed that has a removal/replaceable vibrator cartridge. A need exists for a screed that has folding handle bars that are compound in folding design. A need exists for a screed with extruded blade gussets for strength. A need exists for a screed with blade interchangeable attachments. The present invention provides such a screed.

Figure 3:
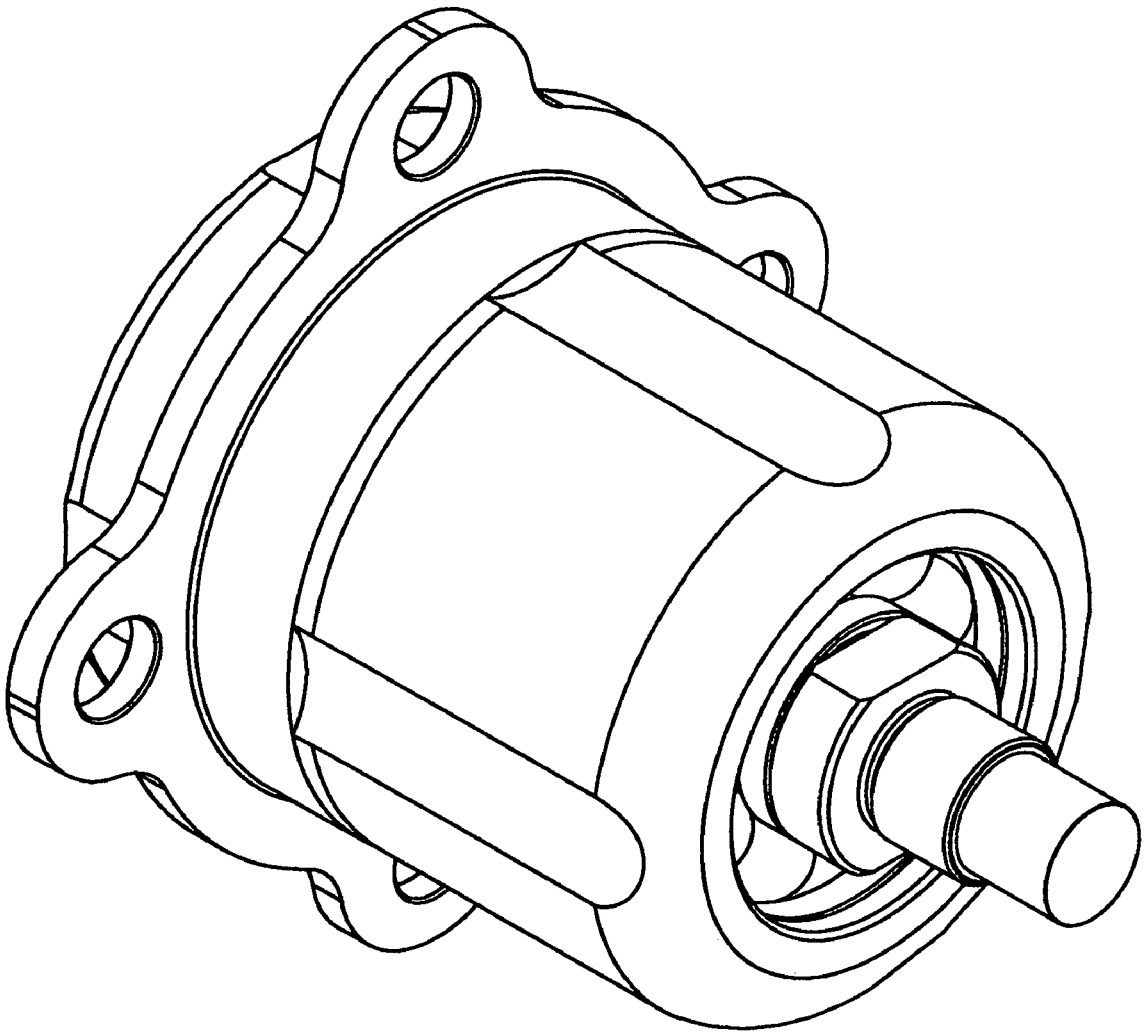

FIG. 3 the "vibrator bearing cartridge assembly".

Figure 4:
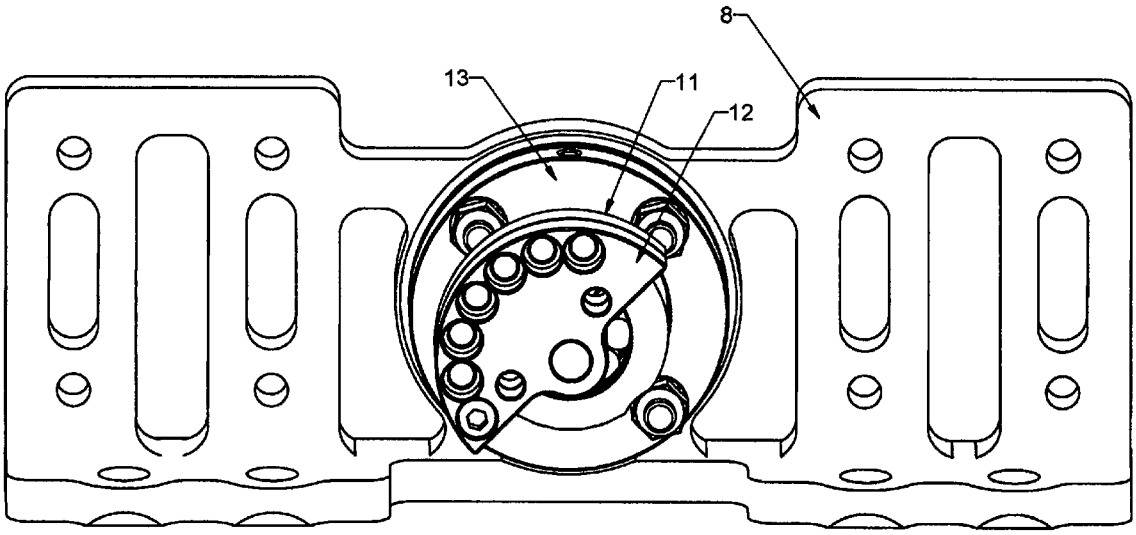

FIG. 4 is a bottom view of the "adjustable eccentric weights" which are attached to the "vibrator bearing cartridge assembly" which is attached to the "blade adapter bracket (#8)

Figure 5:
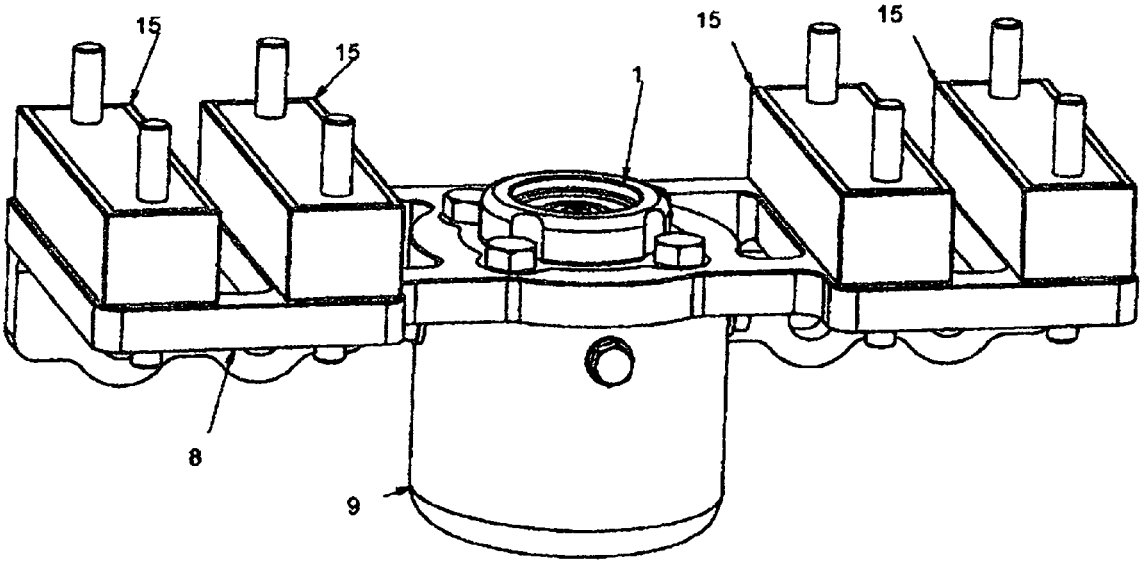

FIG. 5 is the "blade adapter bracket assembly" showing the isolators (#15), "vibrator bearing cartridge assembly" (#1) and "blade adapter bracket" (#8).

Figure 6:
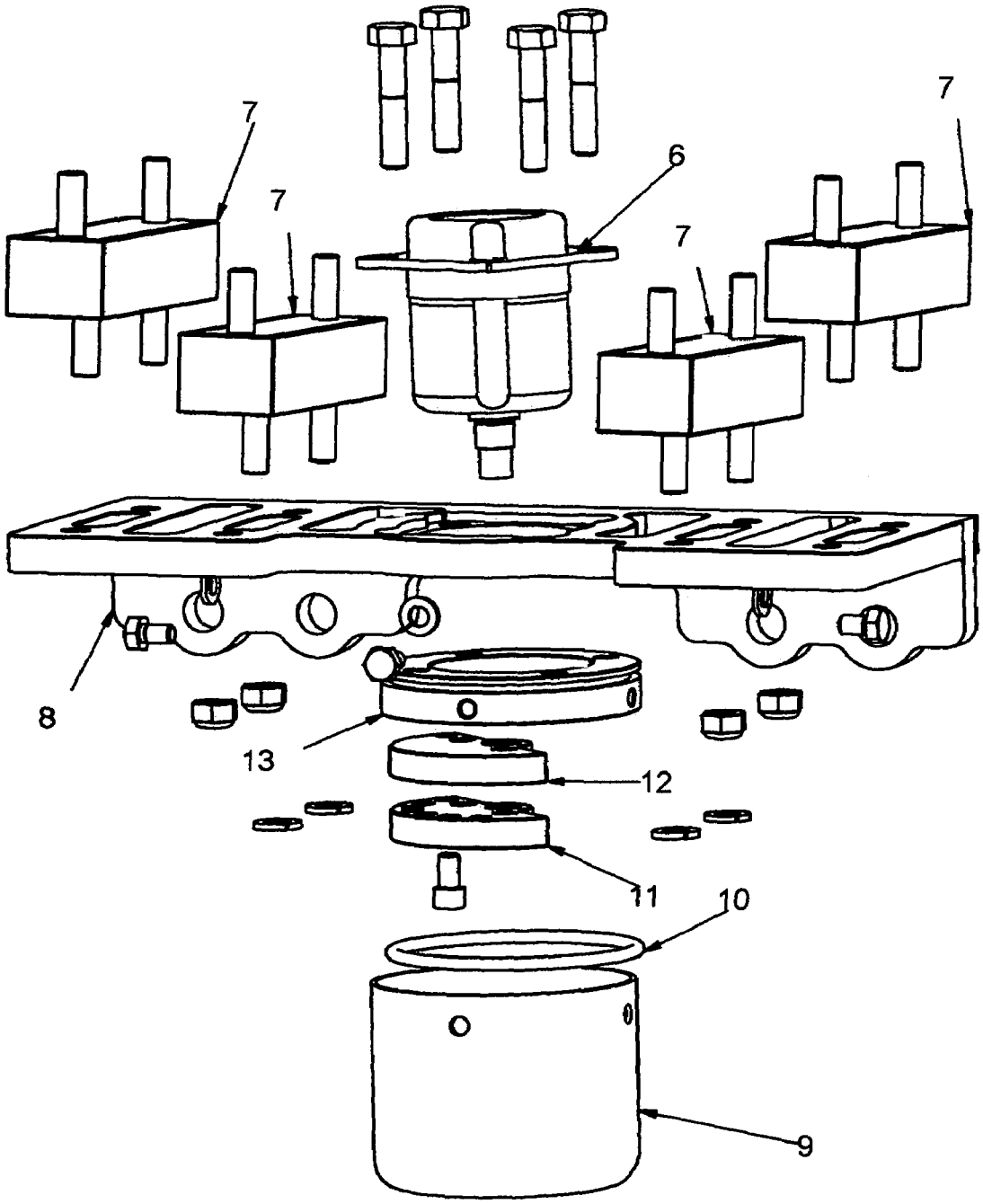

FIG. 6 is the exploded view of FIG. 5, which is the "blade adapter bracket assembly".

Figure 7:
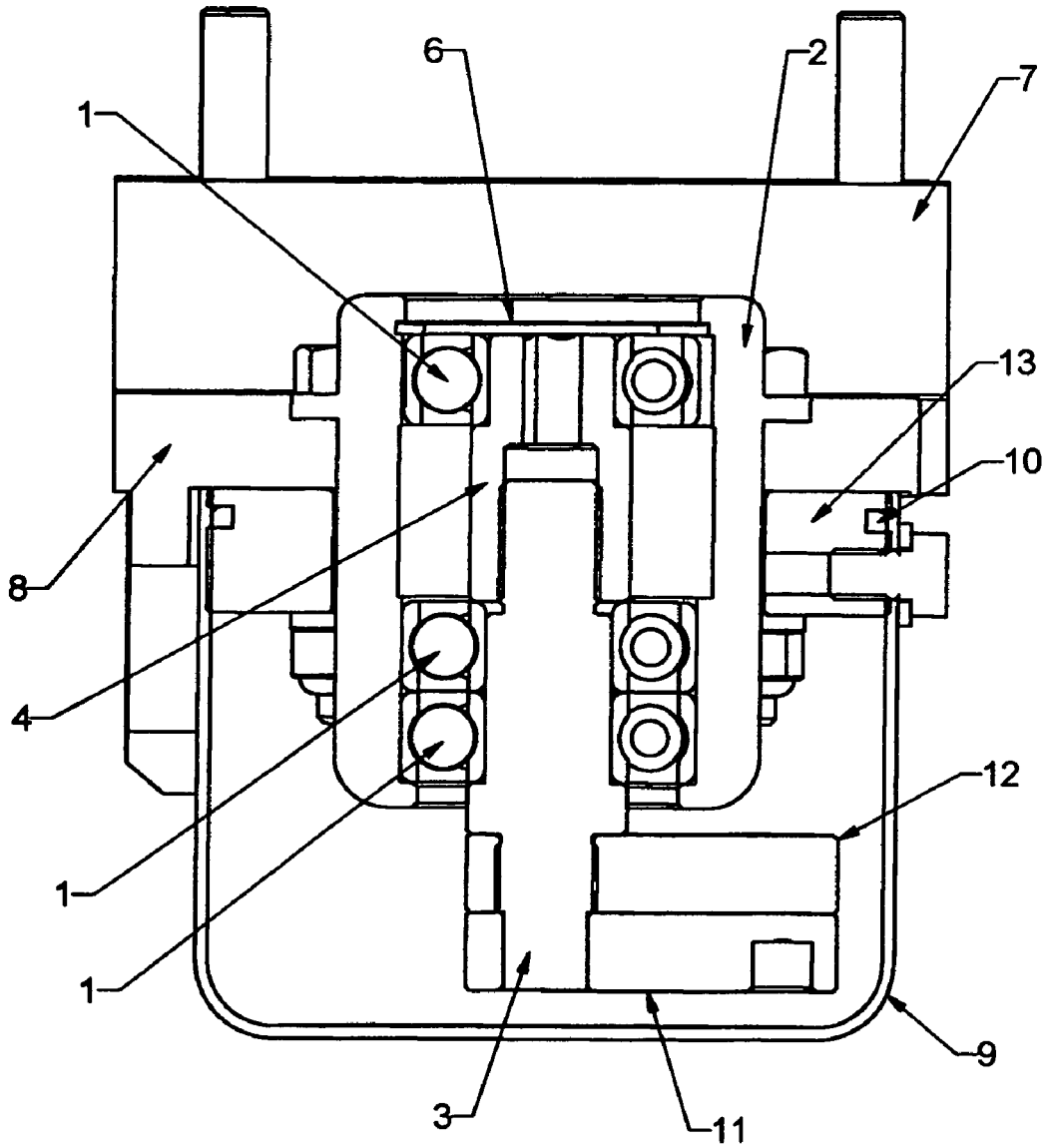

FIG. 7 is a cross section of the "blade adapter bracket assembly".

Figure 8:
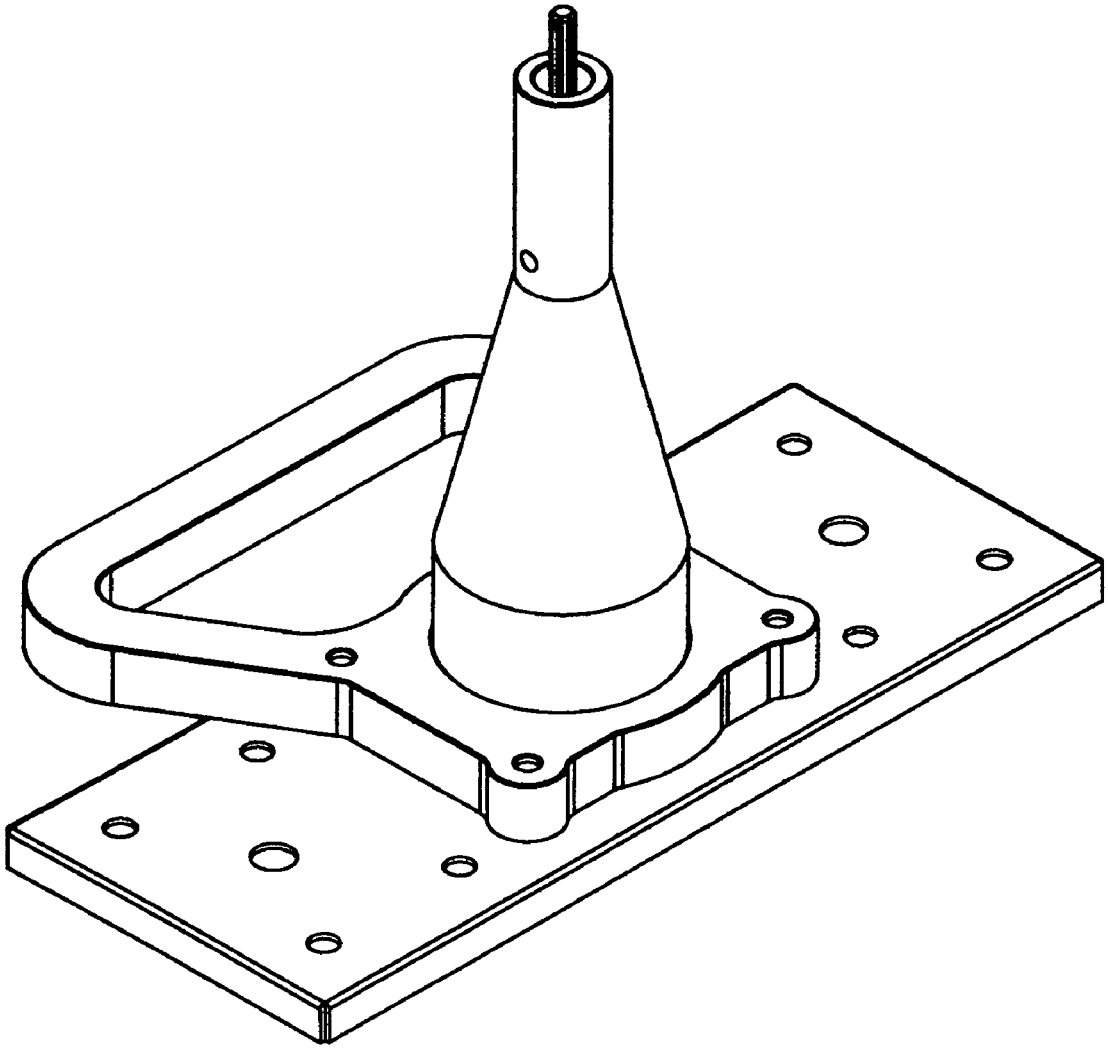

FIG. 8 is the "motor mount assembly".

Figure 9:
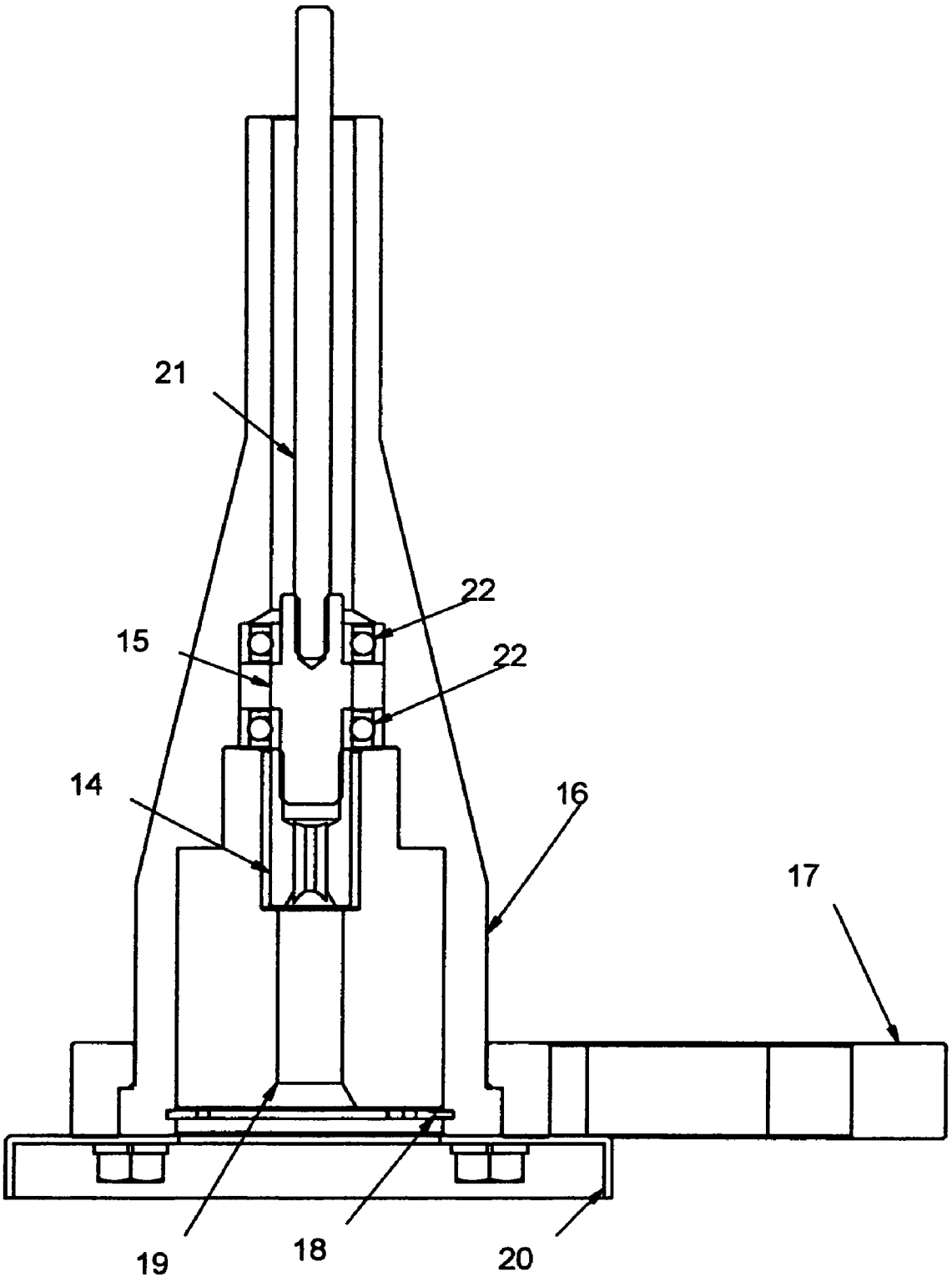

FIG. 9 is a cross-section of the "motor mount assembly"

Figure 10:
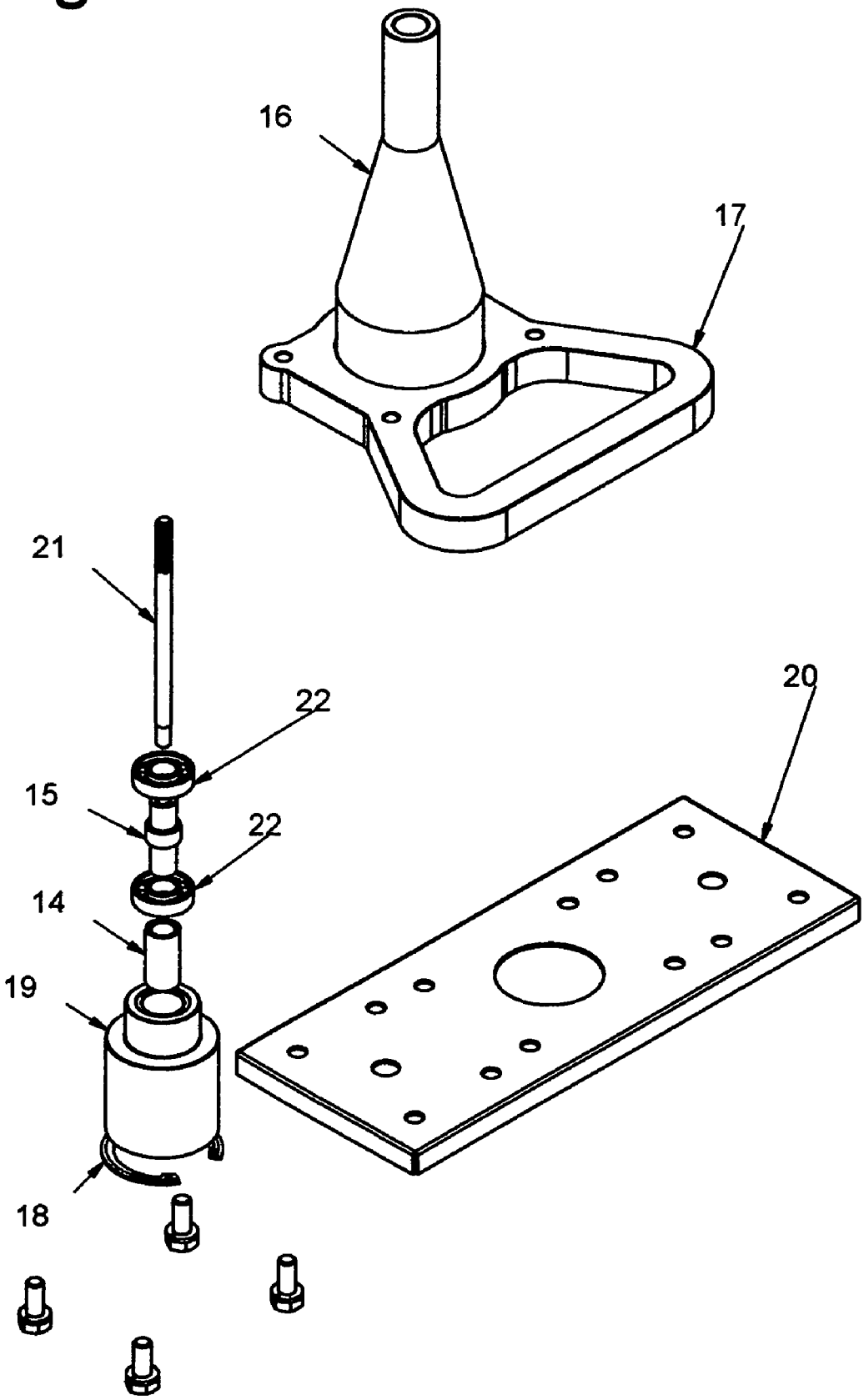

FIG. 10 is an exploded view of the "motor mount assembly" showing all parts and integral "built-in" handle (#17) for lifting and carrying.

Figure 11:
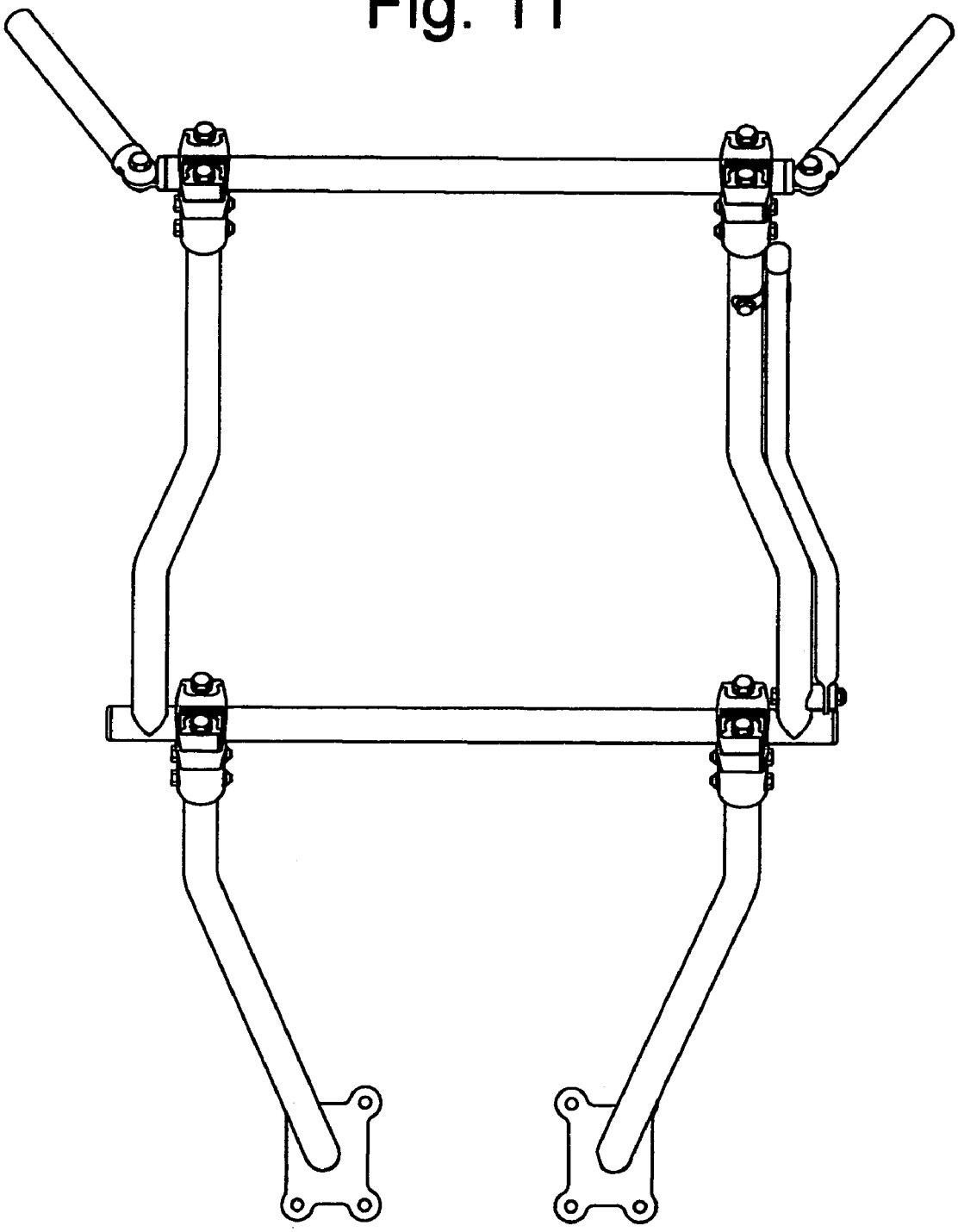

FIG. 11 is a top view of the "collapsible handle bar assembly".

Figure 12:
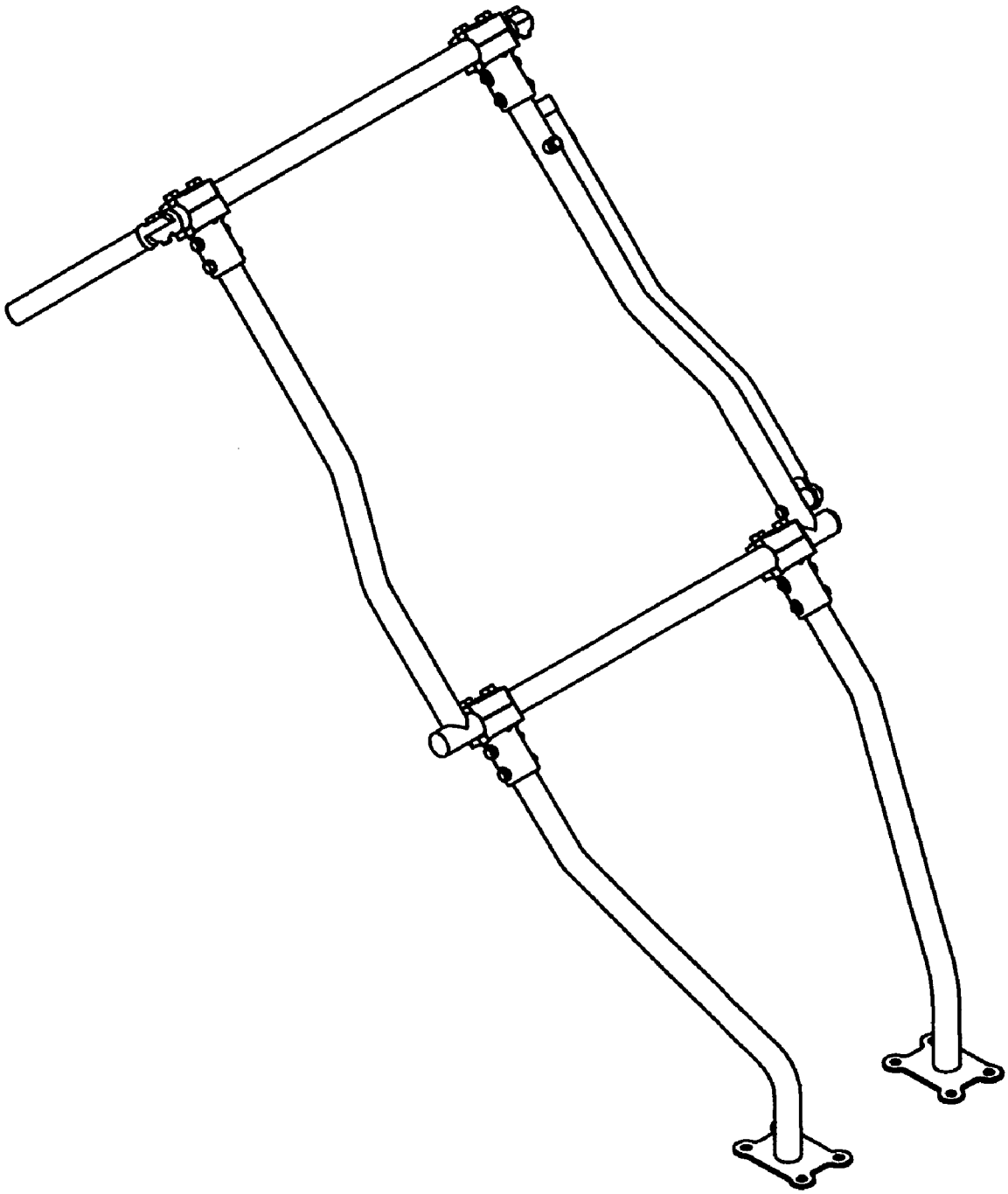

FIG. 12 is an isometric, left view of the "collapsible handle bar assembly".

Figure 13:
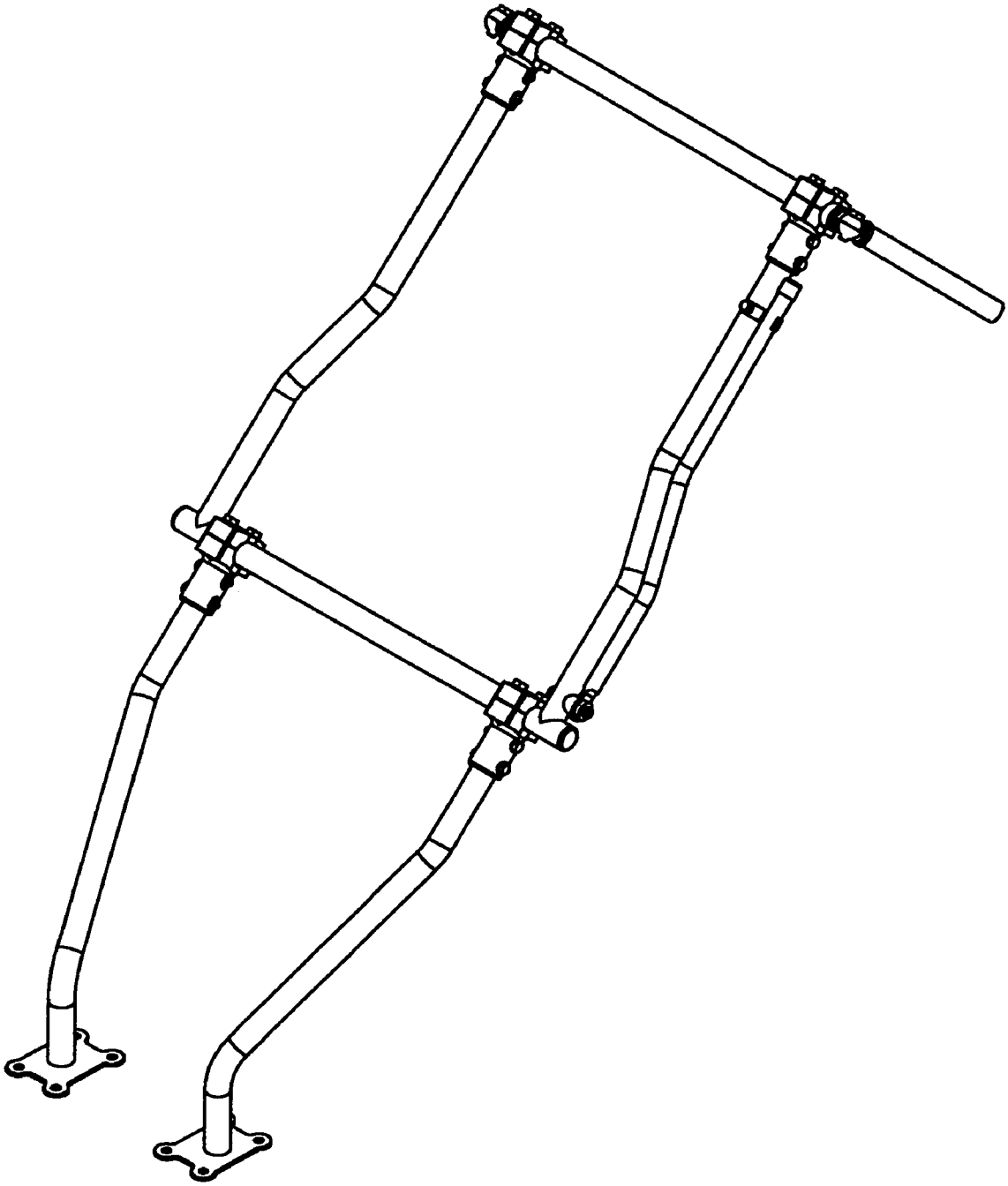

FIG. 13 is an isometric, right view of the "collapsible handle bar assembly".

Figure 14:
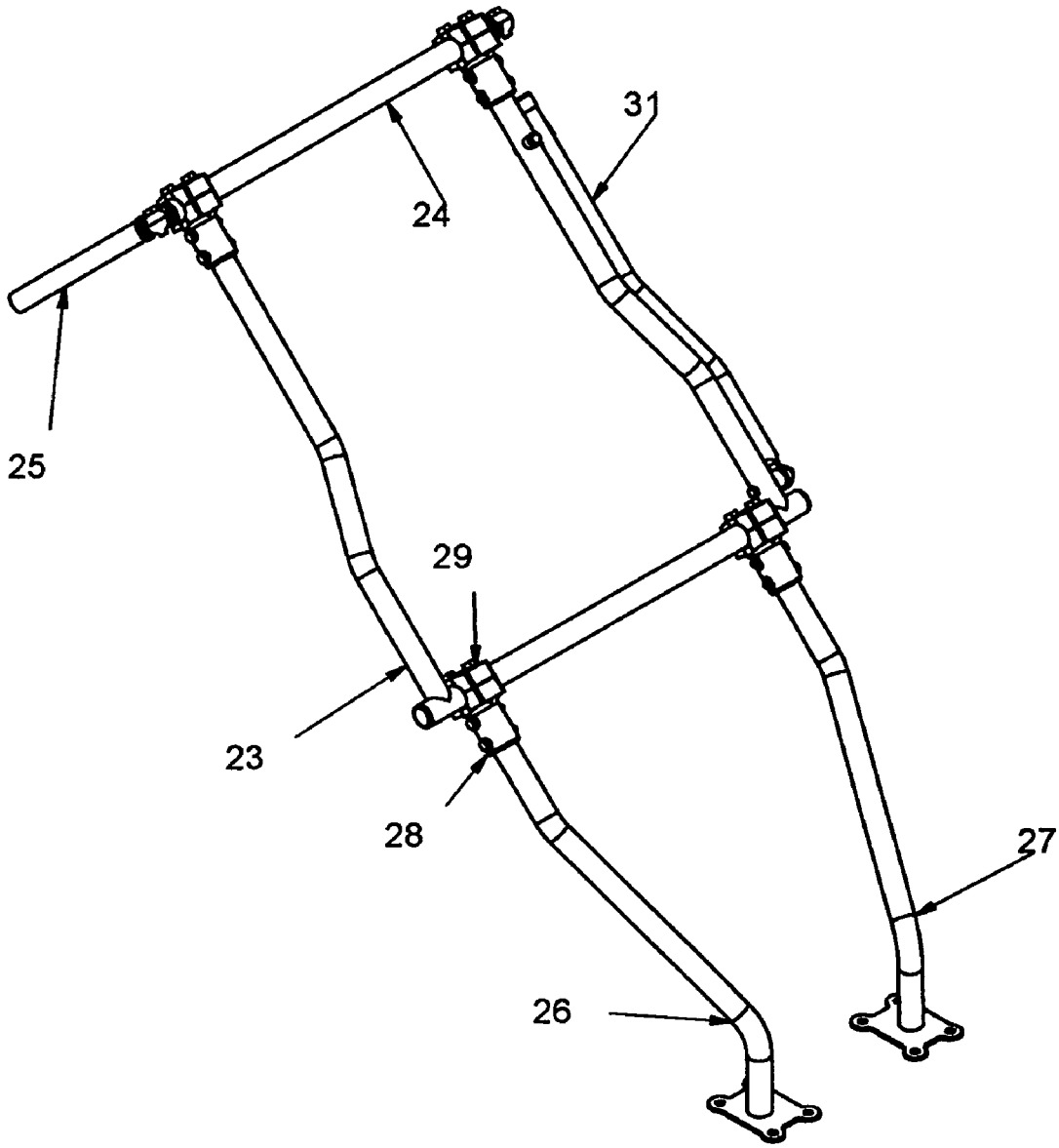

FIG. 14 is an isometric view of the "collapsible handle bar assembly" showing part numbering detail for reference.

Figure 15:
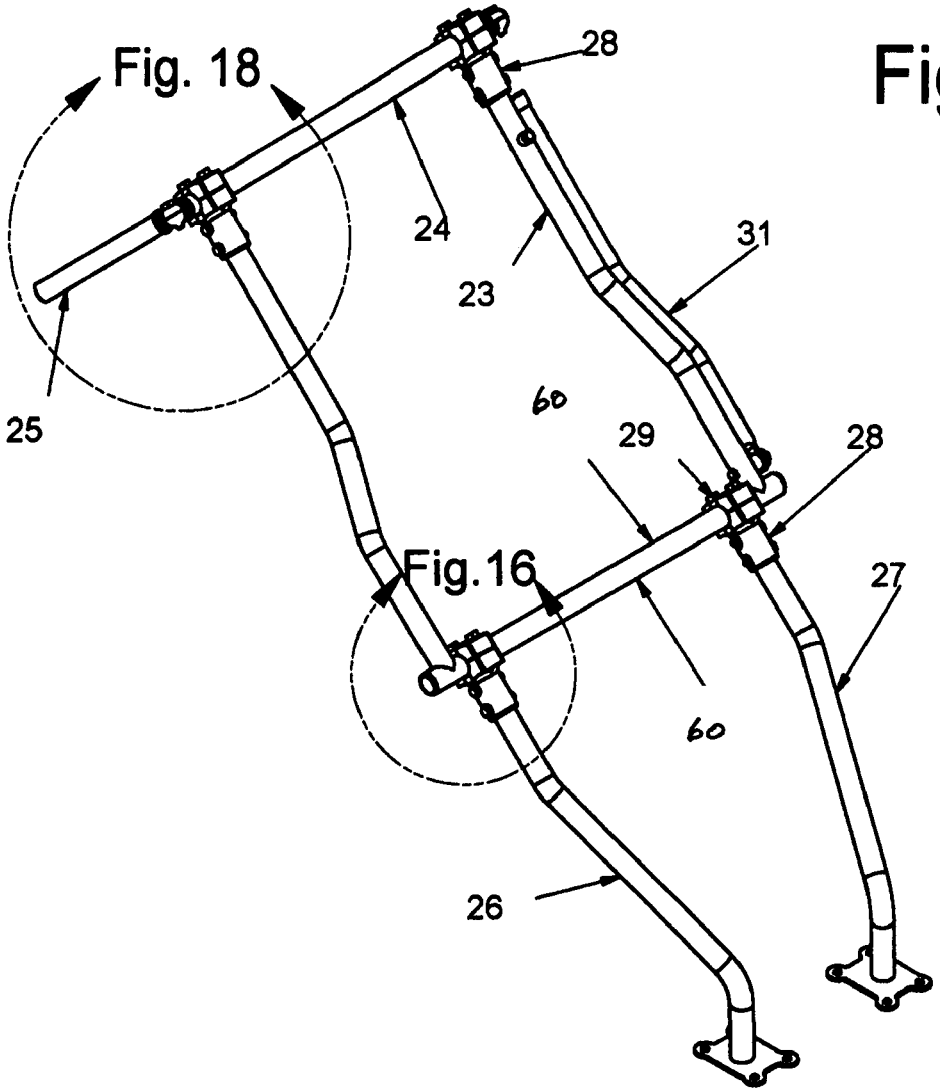
Figure 16:
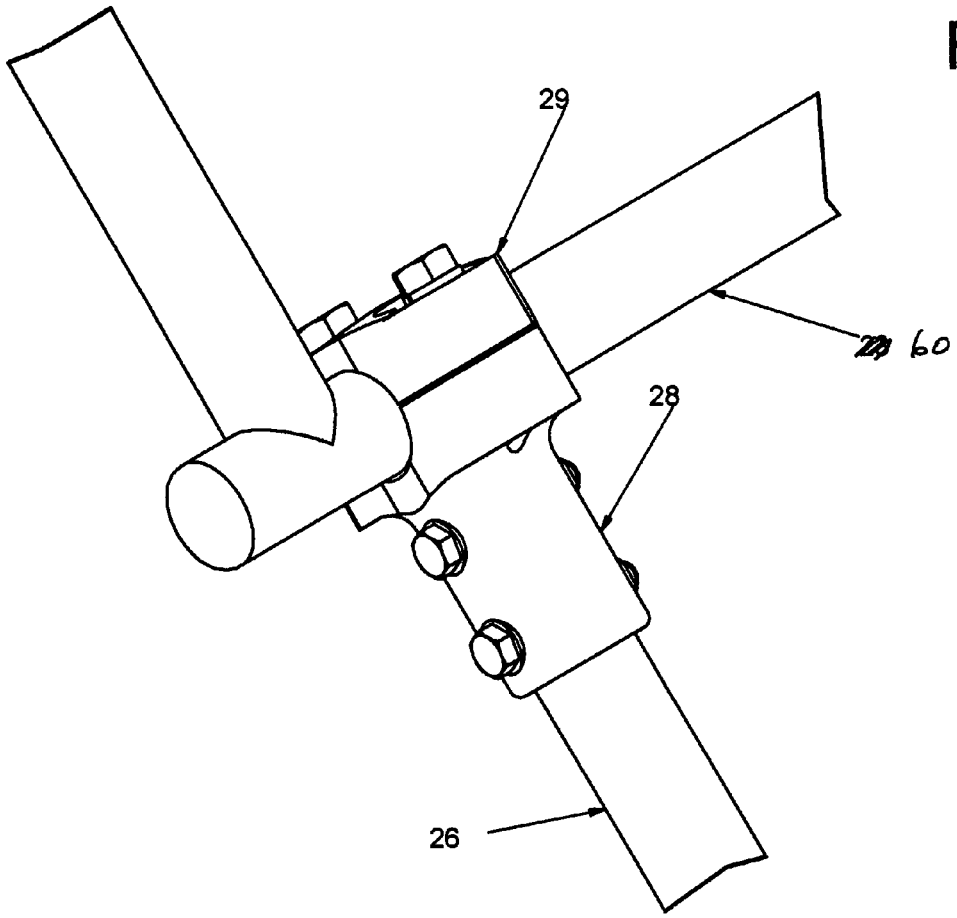
Figure 18:
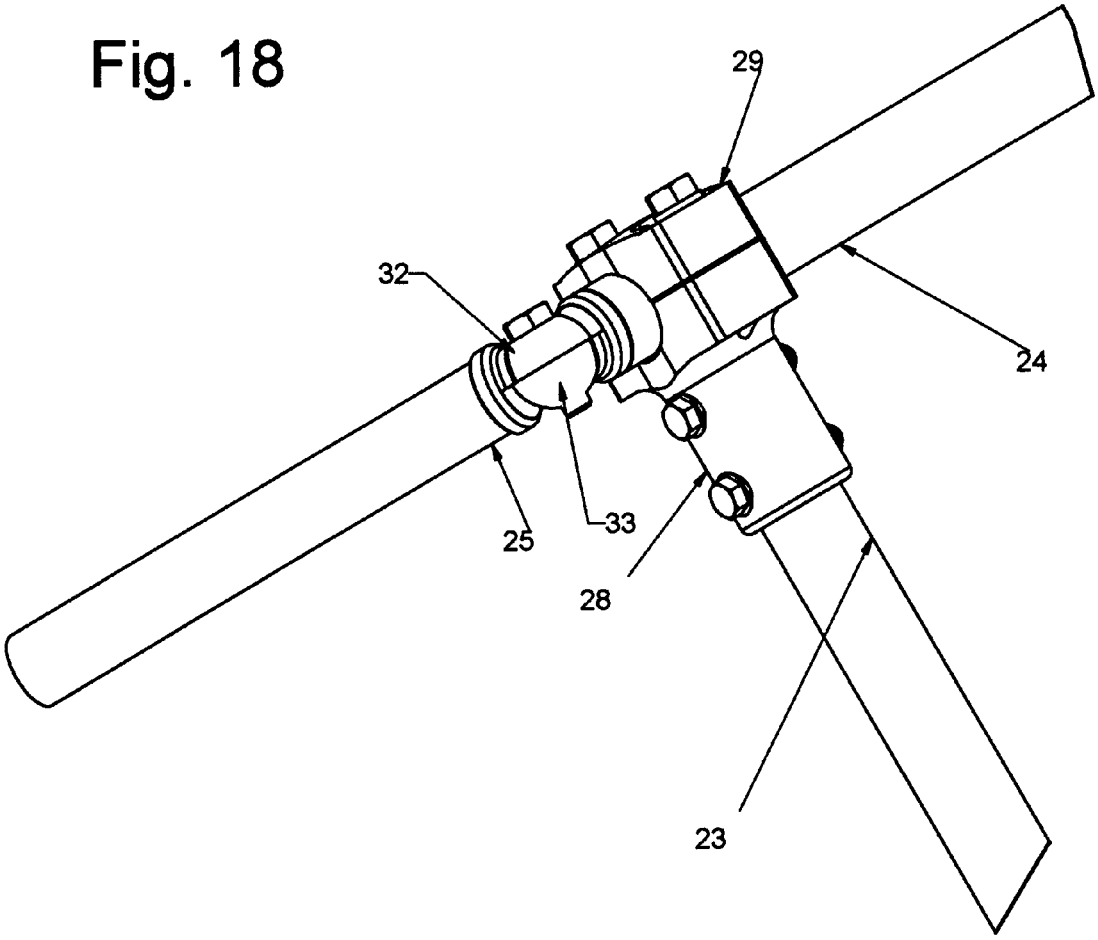

FIG. 15 is a detail view of the clamping and rotating areas of the "collapsible handle bar assembly" shown as FIGS. 16 & 18.

FIG. 16 detailed view of the lower clamping area.

Figure 17:
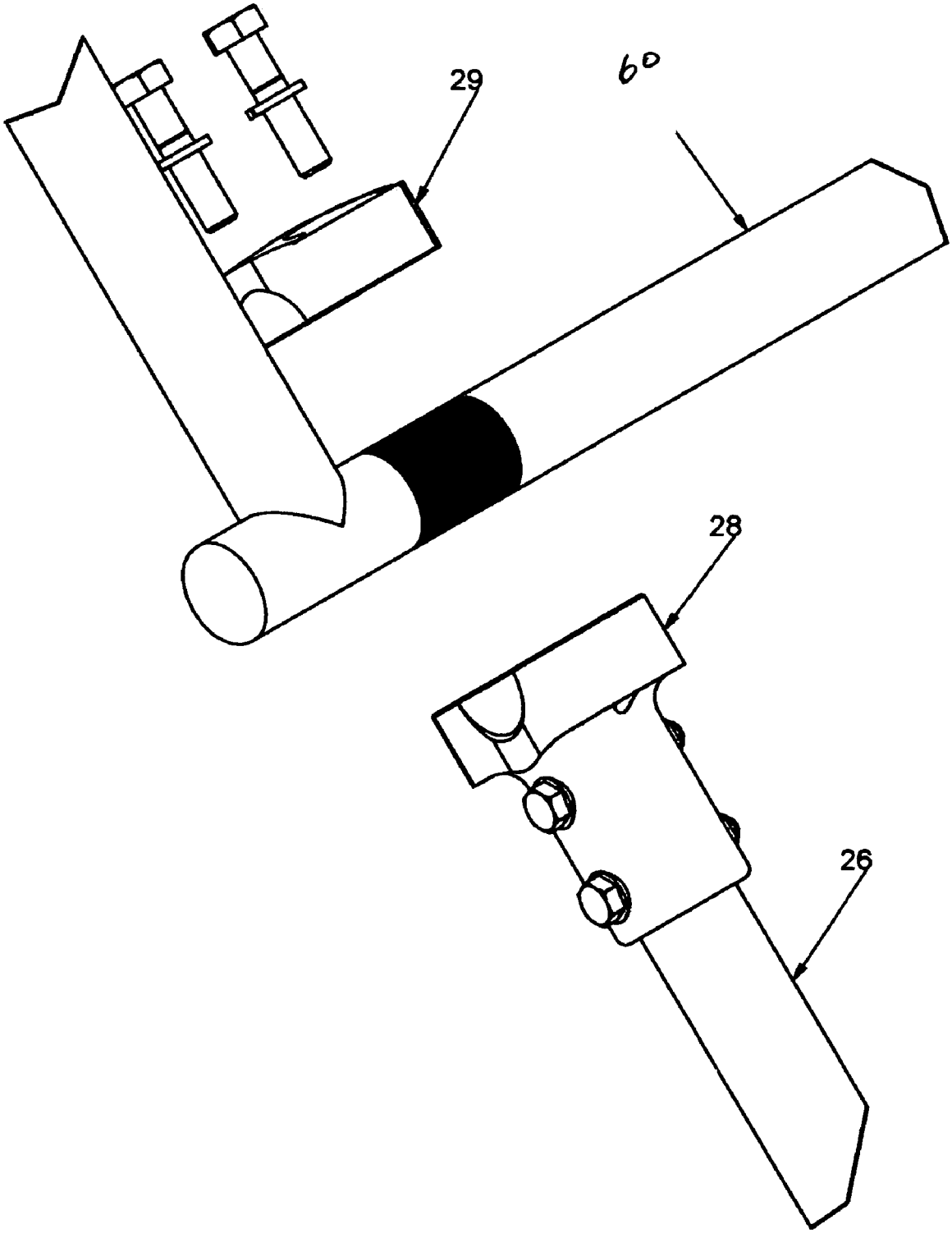

FIG. 17 exploded view of the lower clamping area.

FIG. 18 detailed view of the upper handle bar clamping area.

Figure 19:
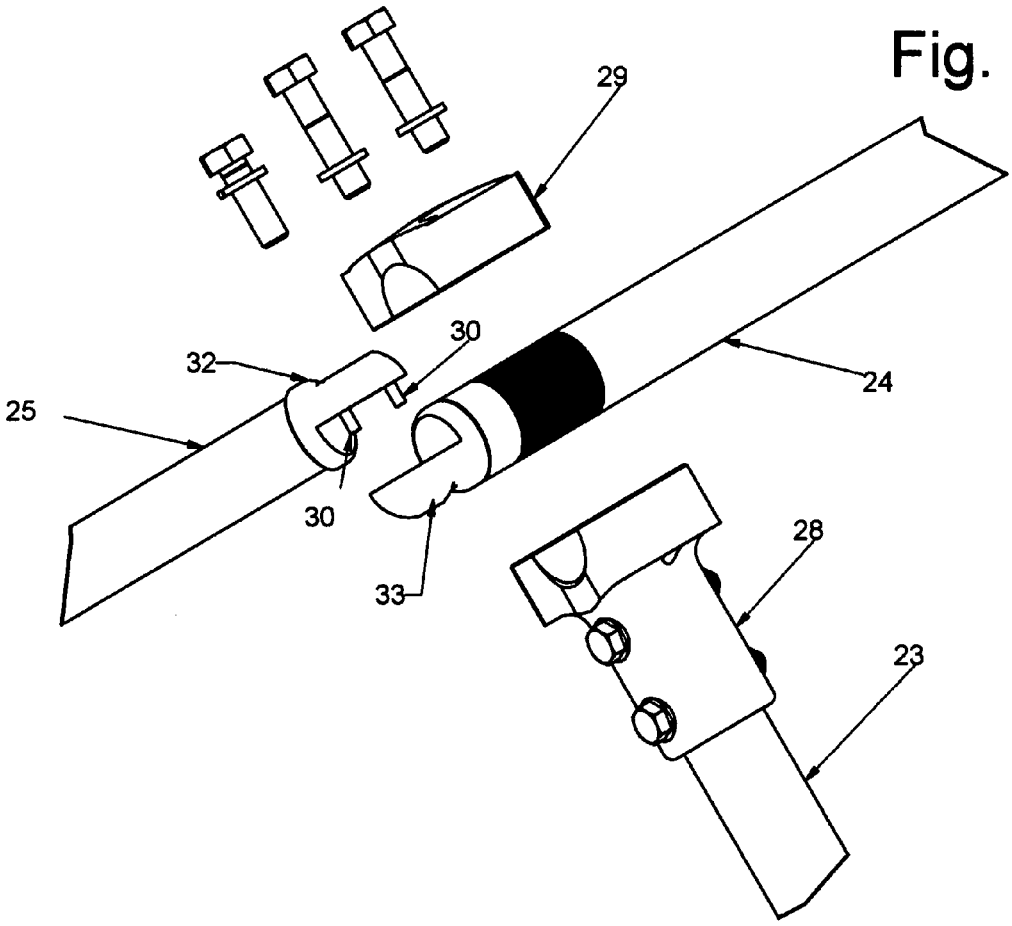

FIG. 19 exploded view of the upper handle bar clamping area.

Figure 20:
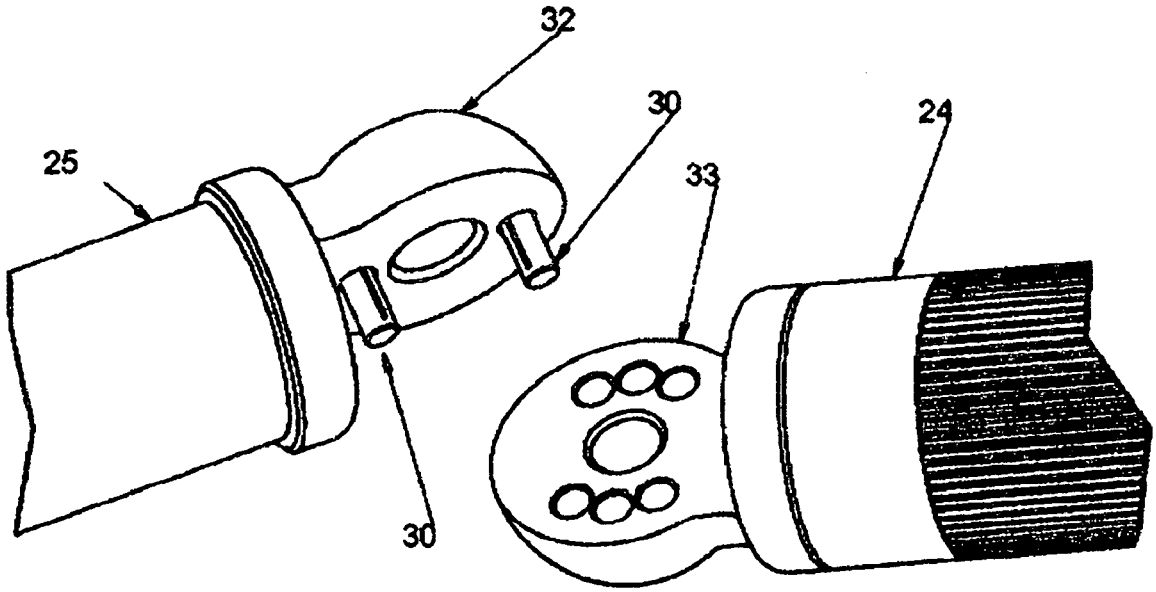

FIG. 20 important detailed view of the locking pins (#30) for accurately positioning the handle grips and adding strength from vibration to keep them from loosening.

Figure 21:
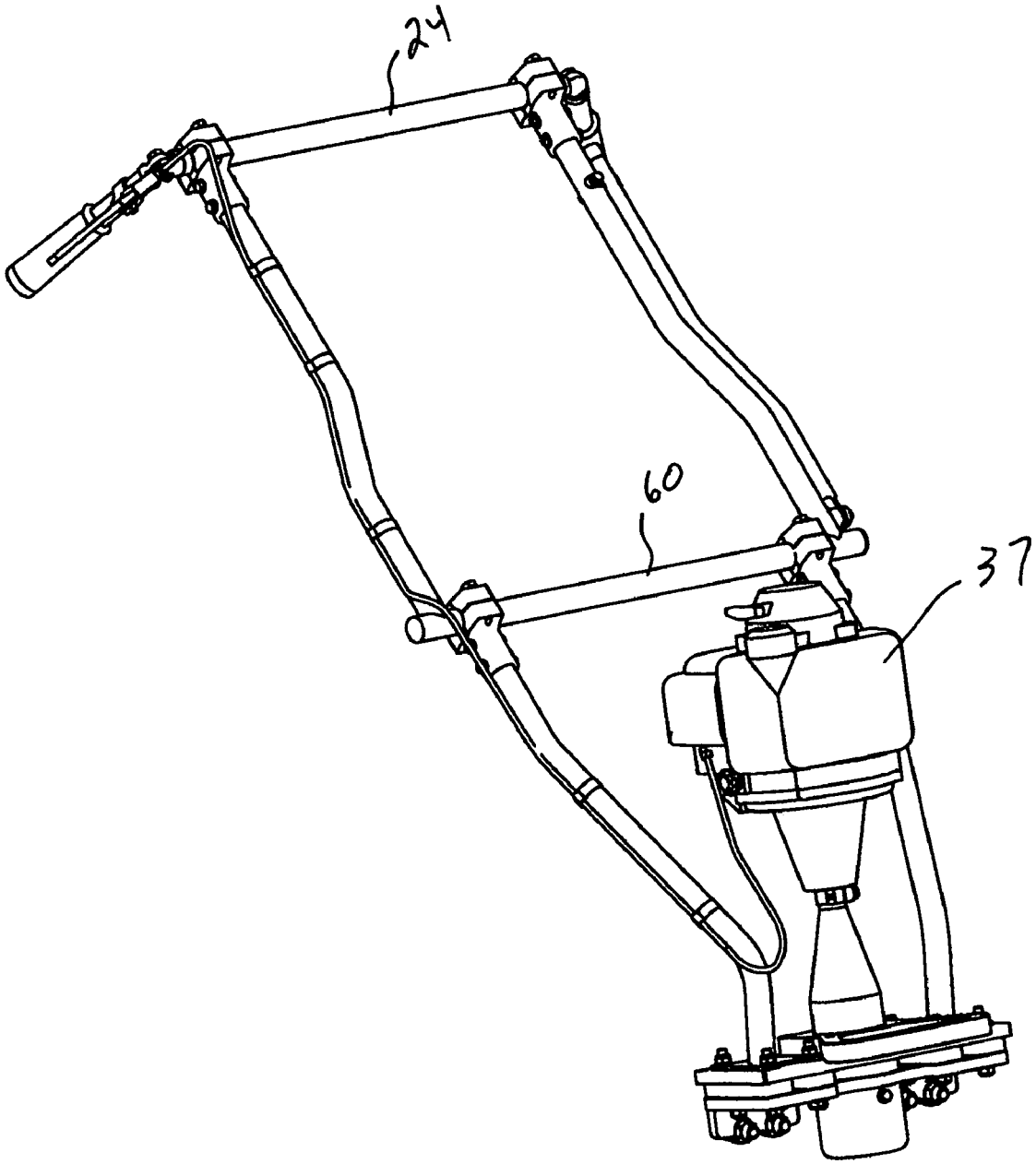

FIG. 21 is a view of the "power platform assembly".

Figure 22:
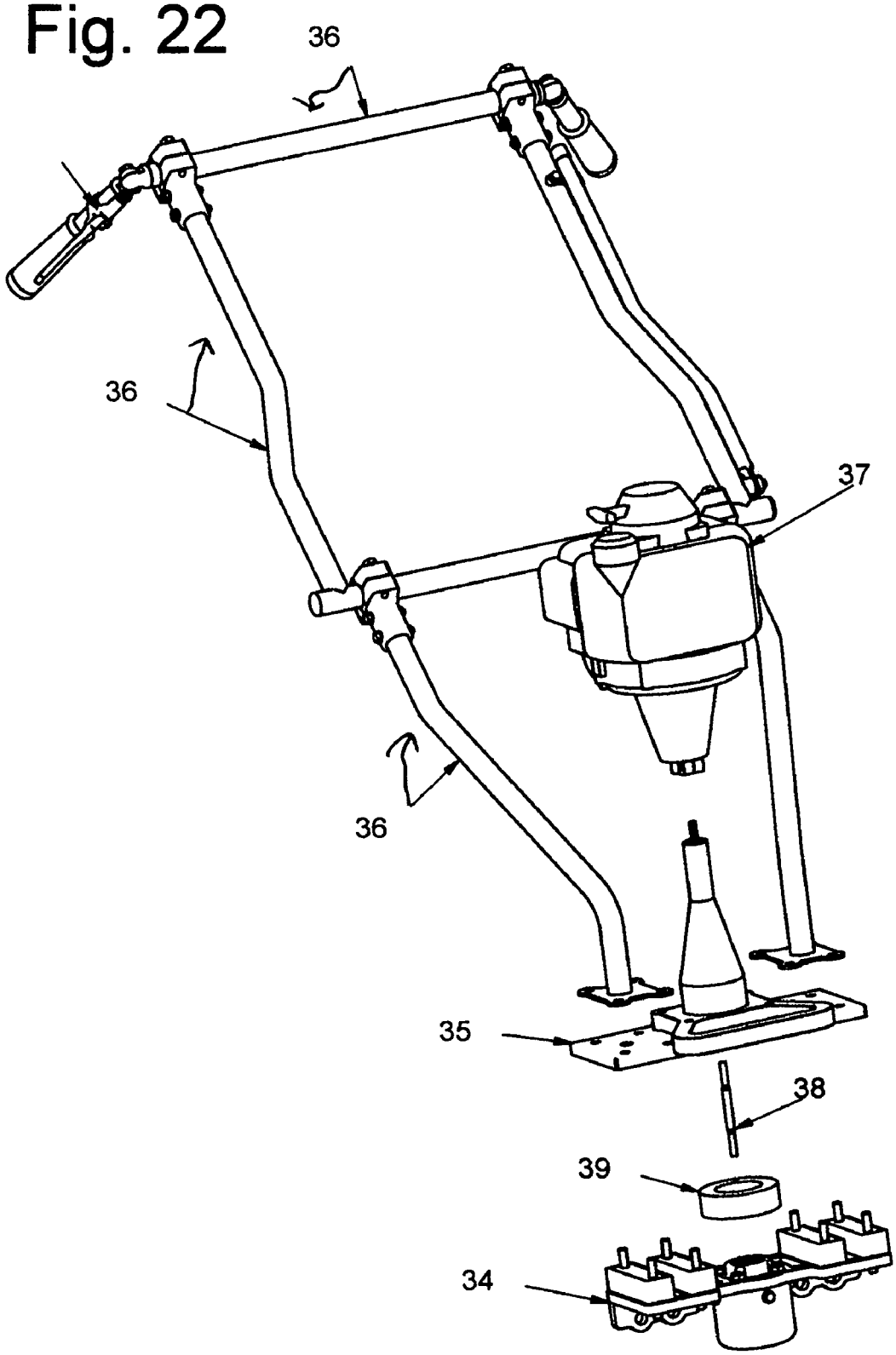

FIG. 22 exploded view of the "power platform assembly" showing "blade adapter bracket assembly" (#34), the "sealing ring" (#39) which keeps concrete out of the drive assembly, "flexible drive joint (#38) which allows for vibration misalignment, and "motor mount assembly".

Figure 23:
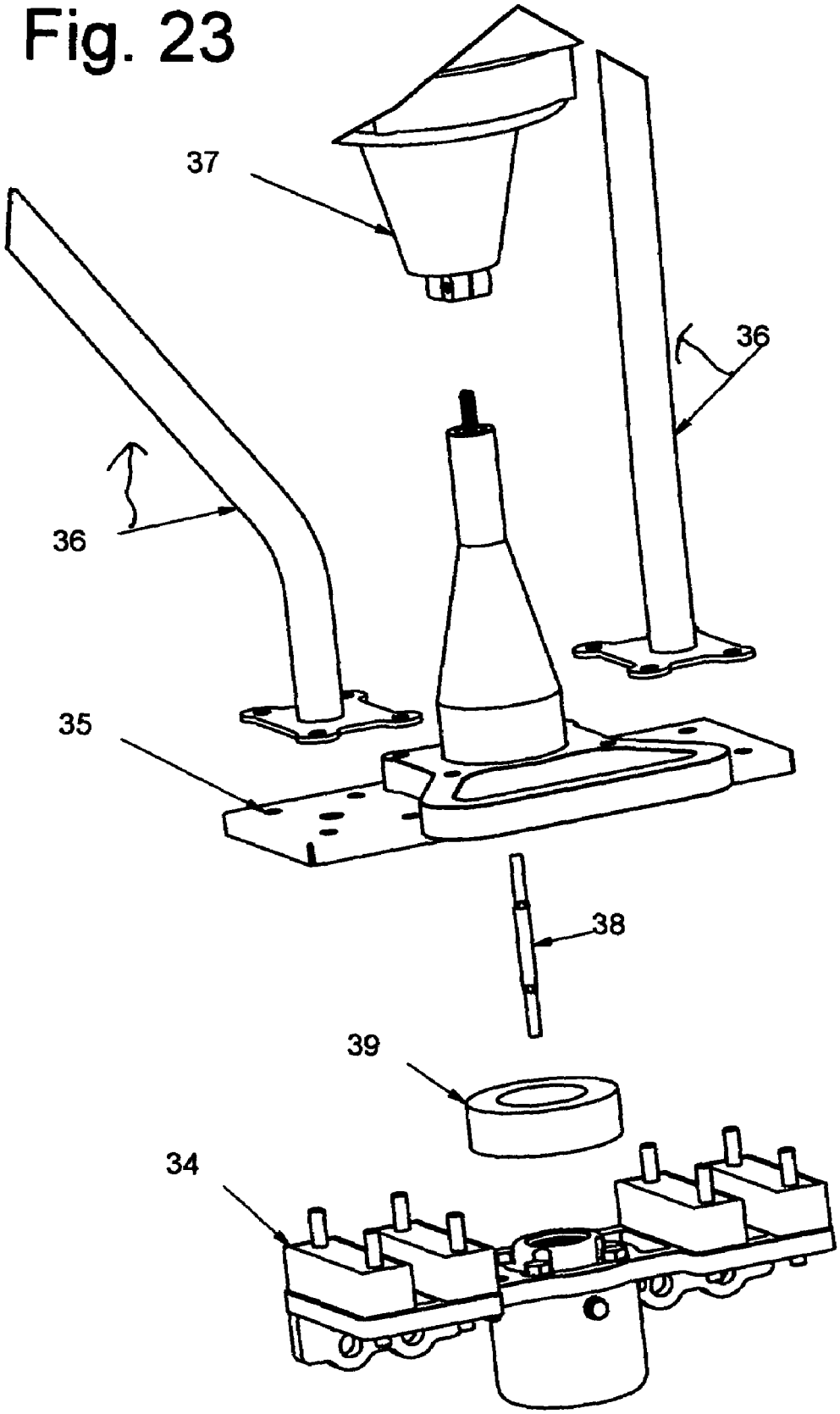

FIG. 23 detailed view of the exploded view of the "power platform assembly".

Figure 24:
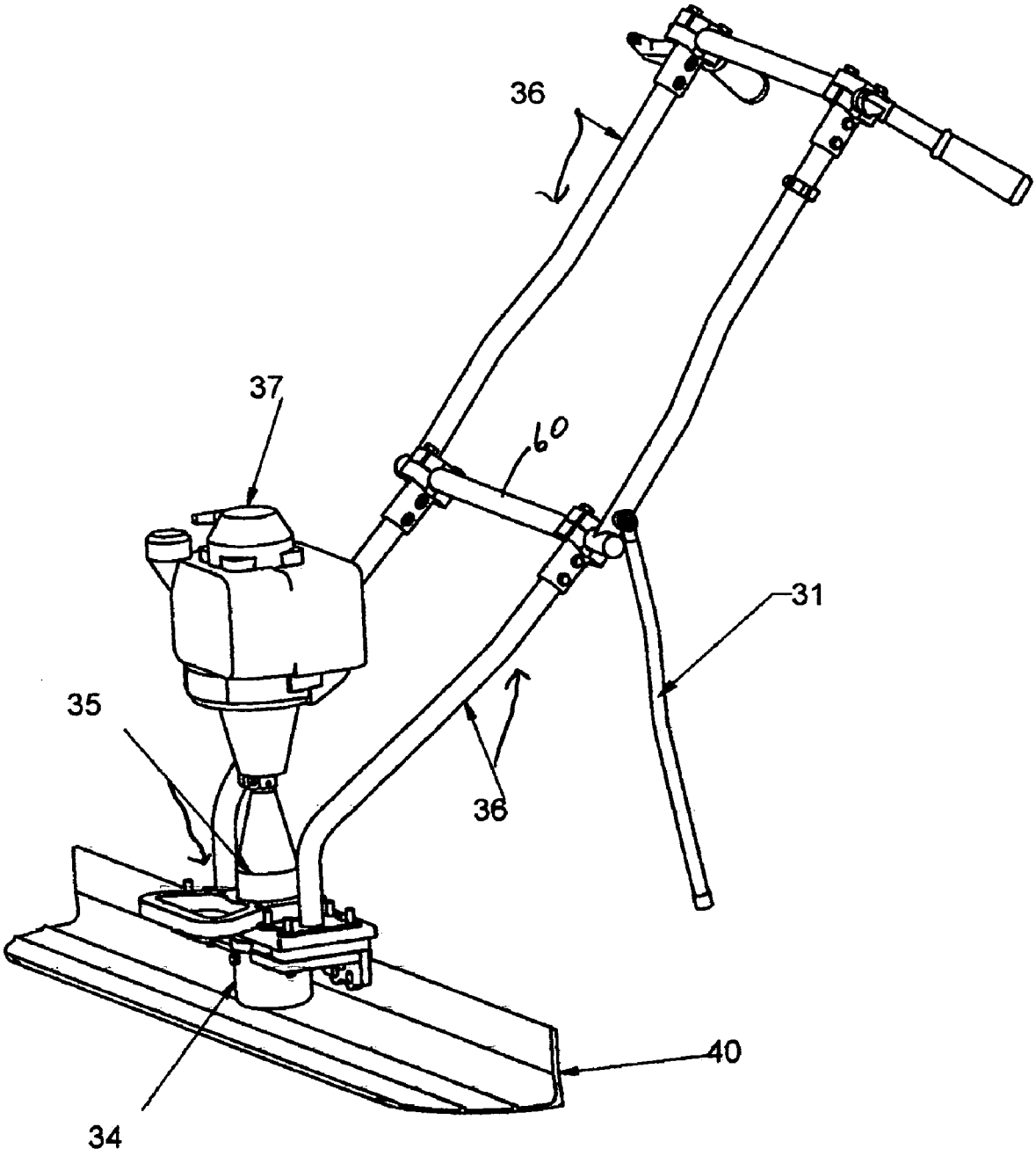

FIG. 24 is a view of the "power platform assembly" attached to "blade" (#40).

Figure 25:
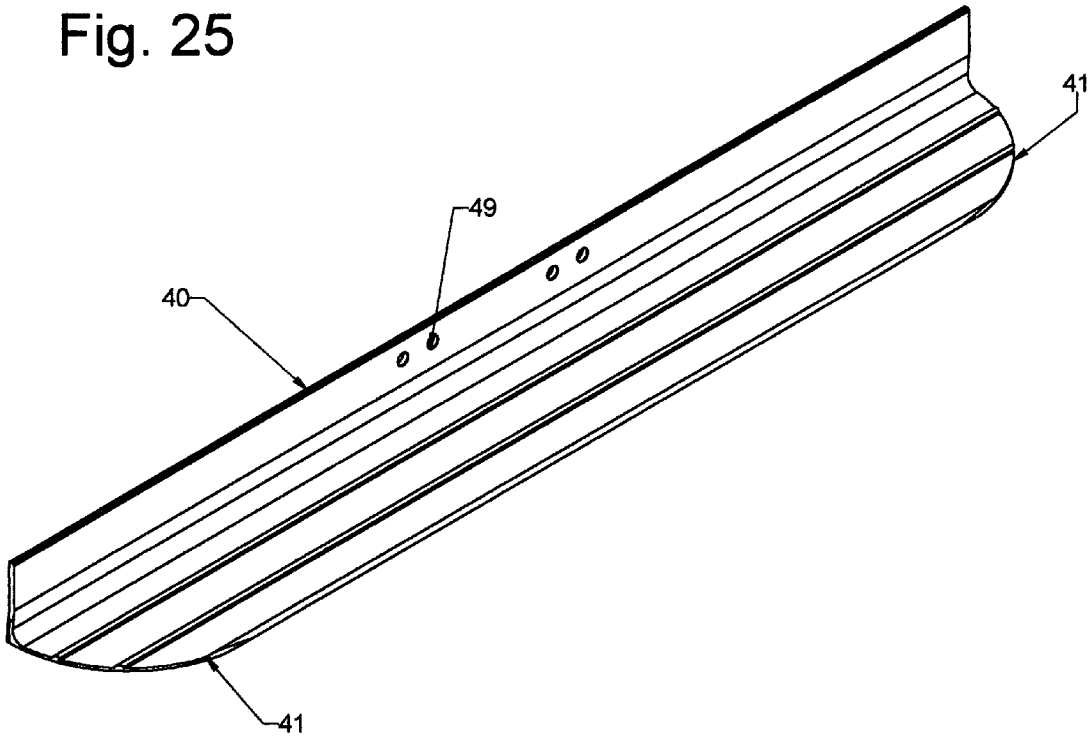

FIG. 25 is a view of the "blade"

Figure 26:
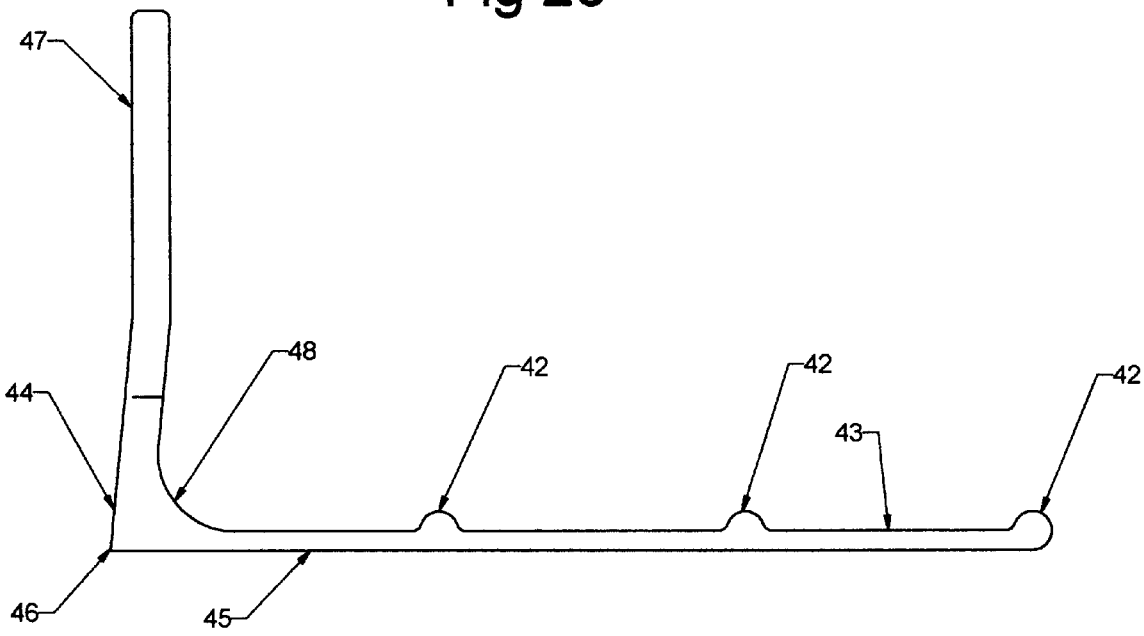

FIG. 26 is a cross-section of the "blade", detail is structural ribs (#42) added to blade length for increasing strength from vibration amplitude. These ribs are for blade strength, as well as to transfer the vibration energy evenly across the blade. (#46) is the "cutting edge of blade", (#41) is round end of the blade to avoid leaving lines in the concrete which is common to all blades used for finishing concrete.

Figure 27:
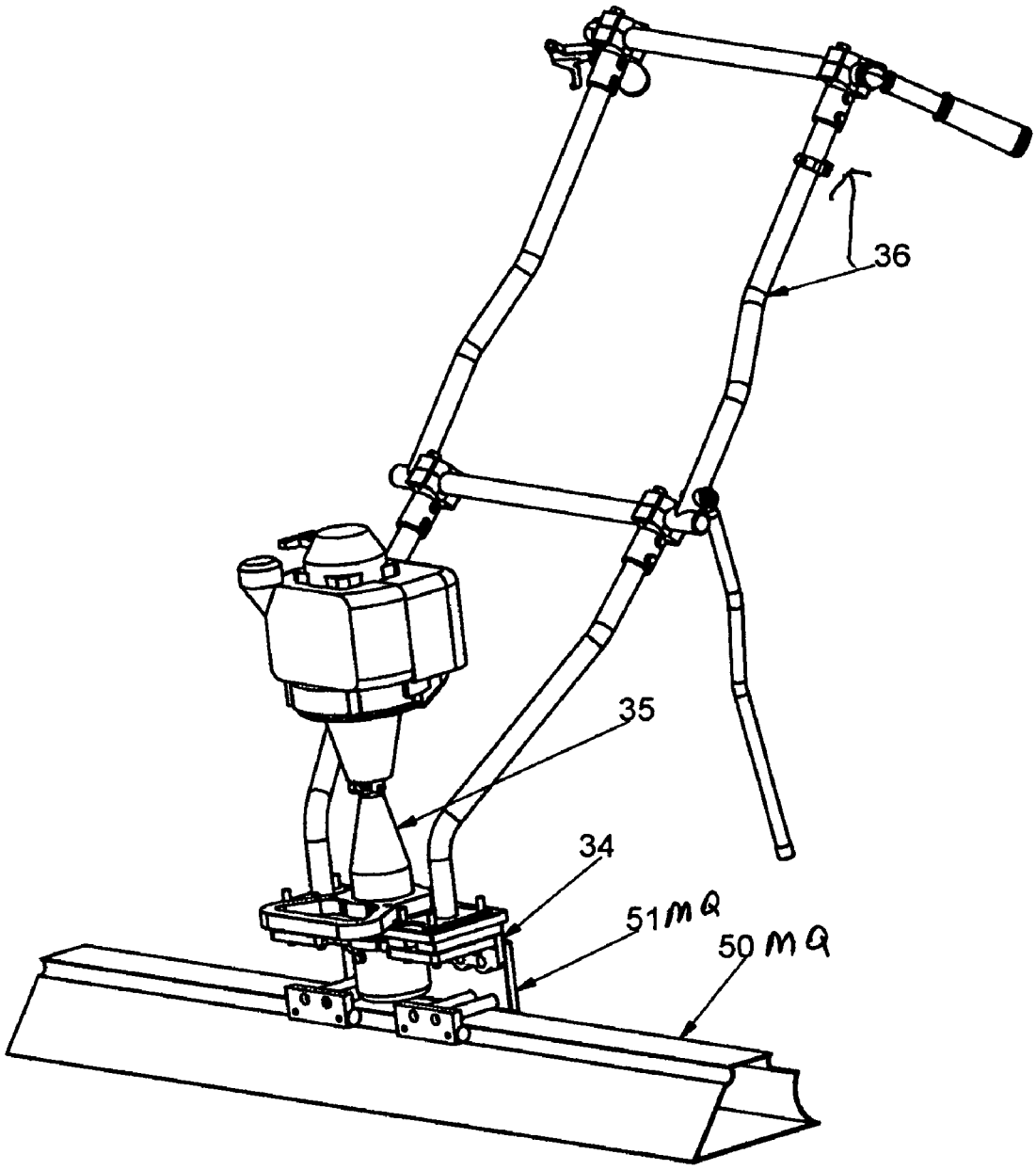

FIG. 27 is the "power platform assembly" adapted to the competitive blade design of Multi-Quip (#50).

Figure 28:
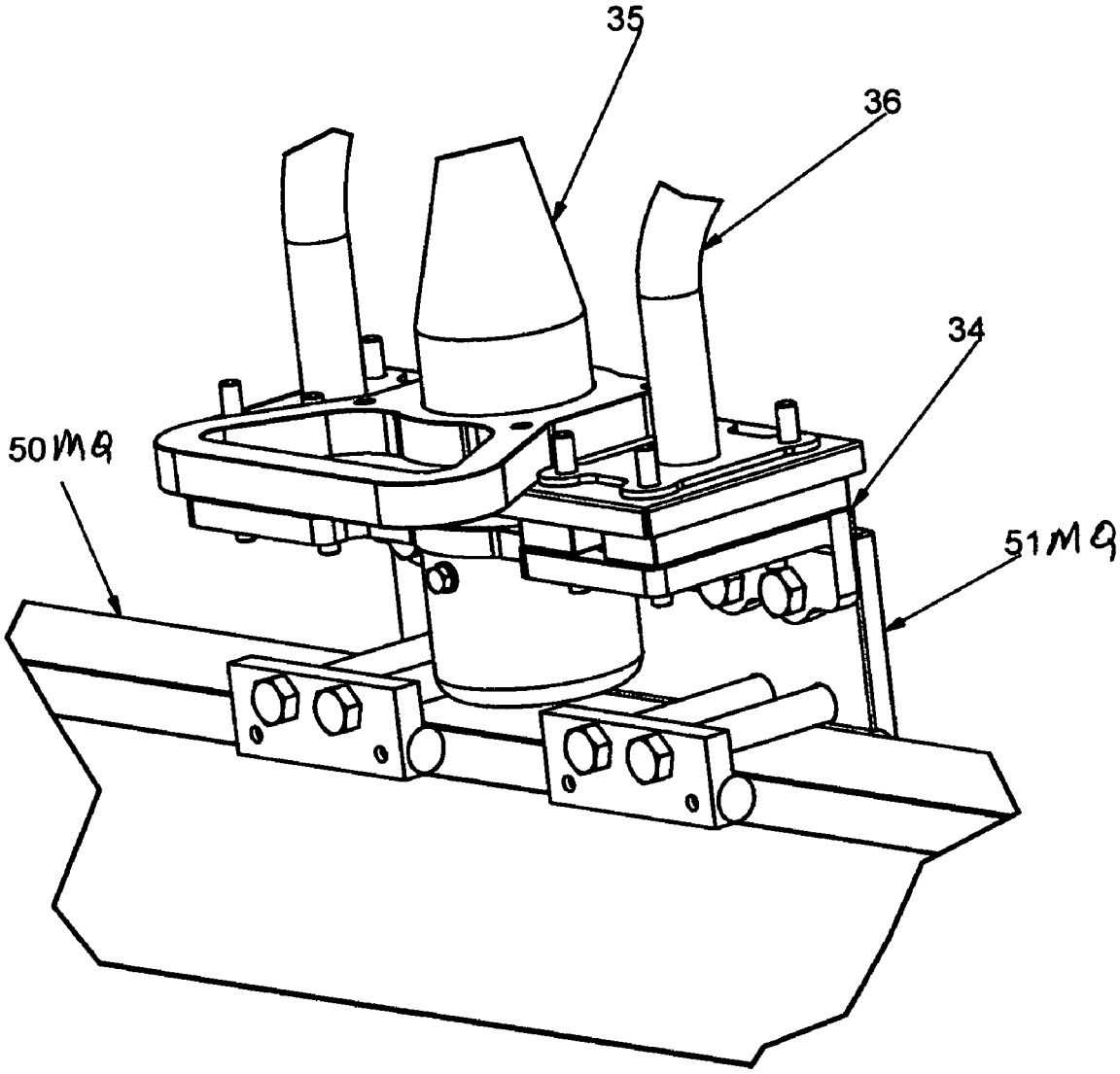

FIG. 28 is a detailed view of the "power platform assembly" attached to the Multi-Quip blade design (#50).

Figure 29:
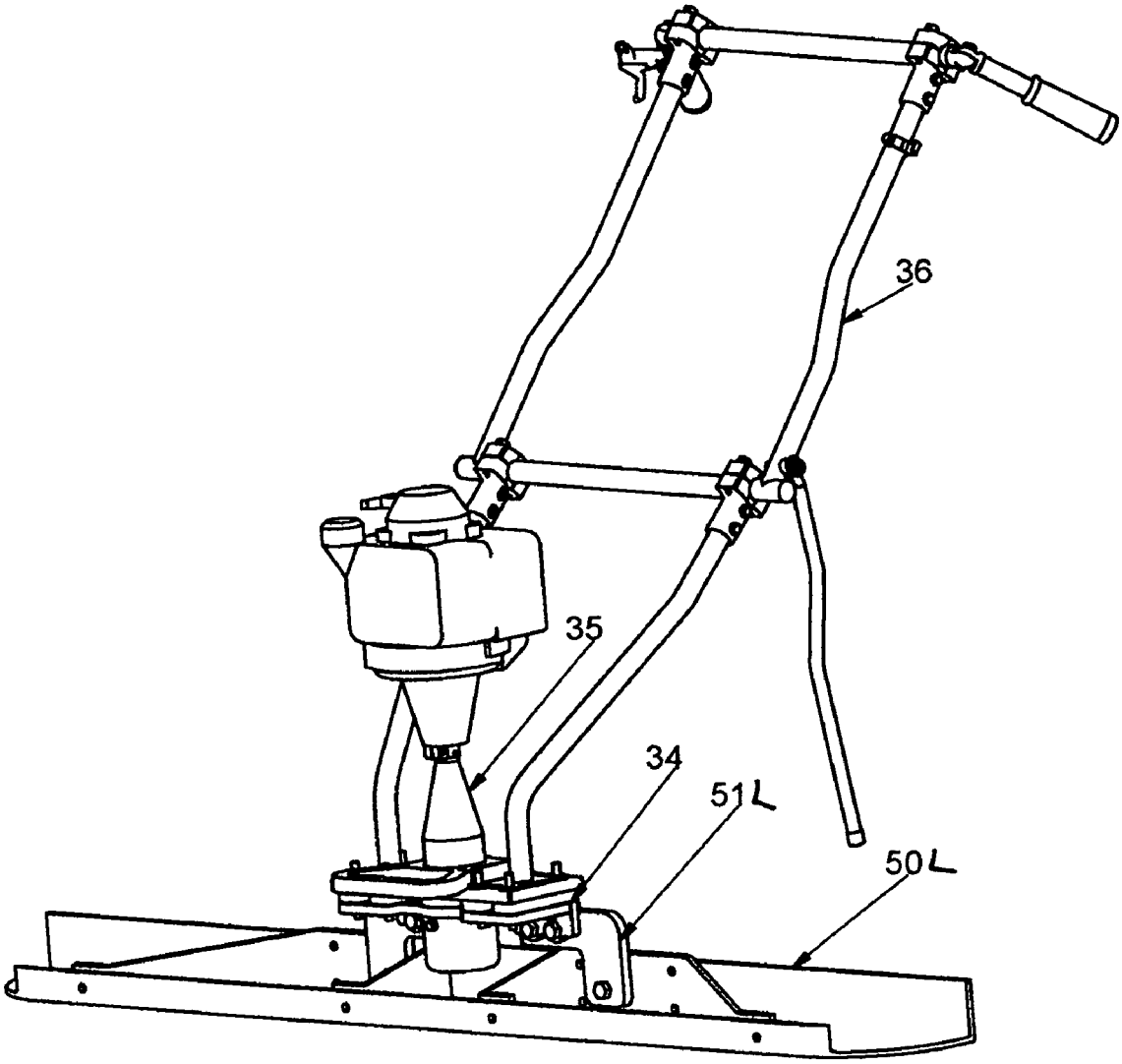

FIG. 29 is the "power platform assembly" adapted to the competitive blade design of Lindley (Vibra Strike)

Figure 30:
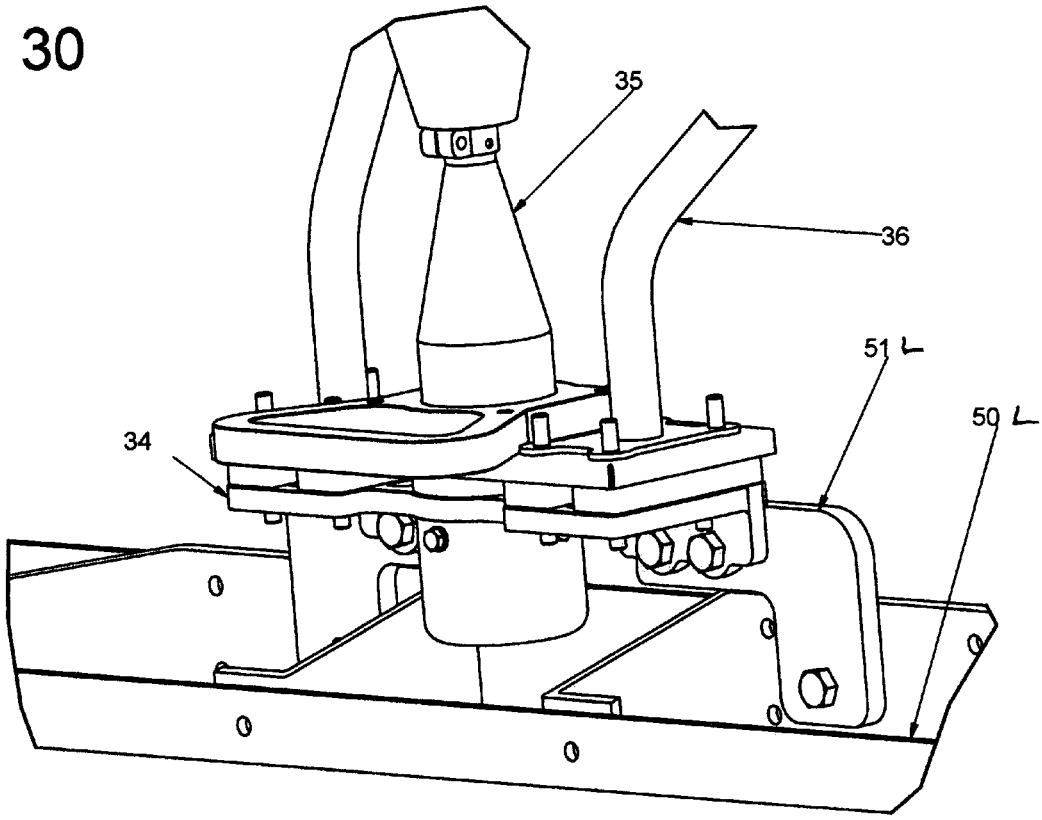

FIG. 30 is a detailed view of the "power platform assembly" attached to the Lindley blade design (#50)

Figure 31:
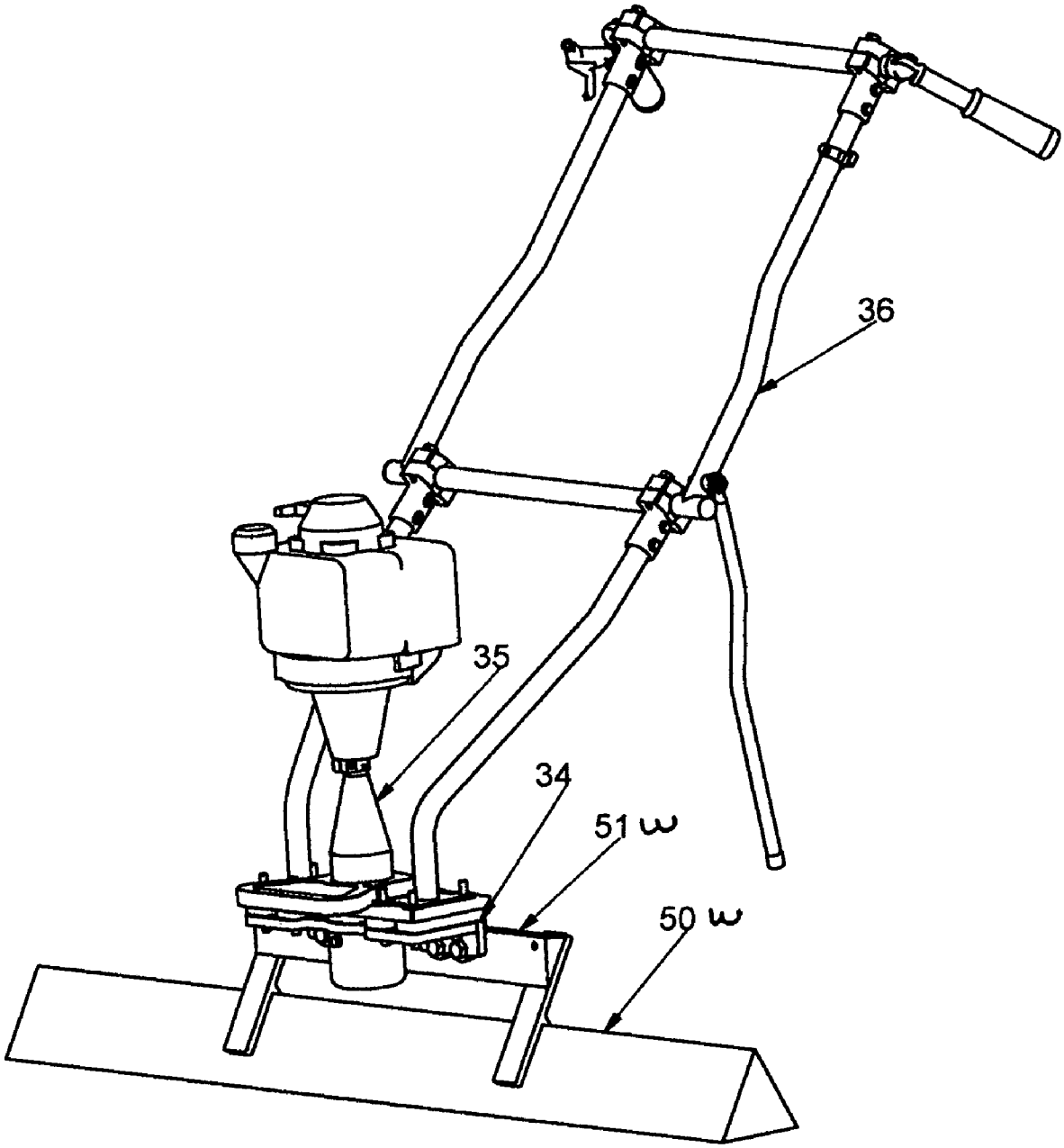

FIG. 31 is the "power platform assembly" adapted to the competitive blade design of Weber.

Figure 32:
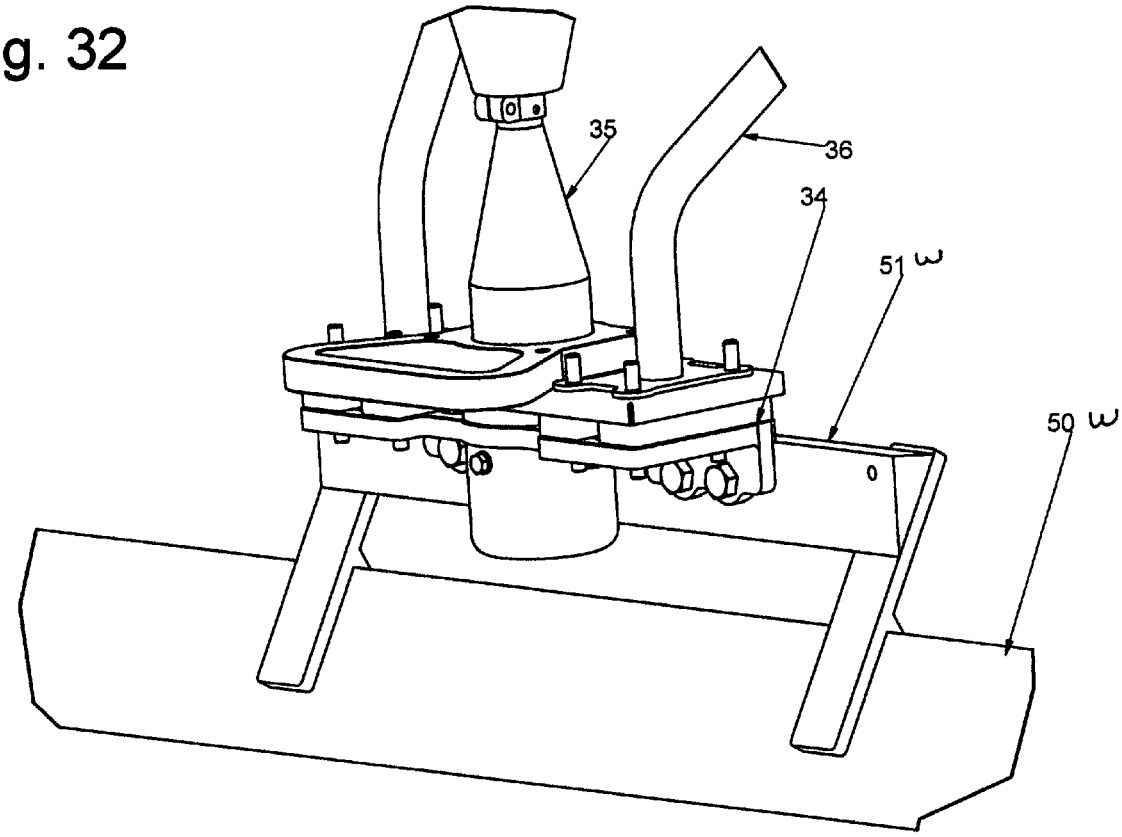

FIG. 32 is a detailed view of the "power platform assembly" attached to the Weber blade design.

Figure 33:
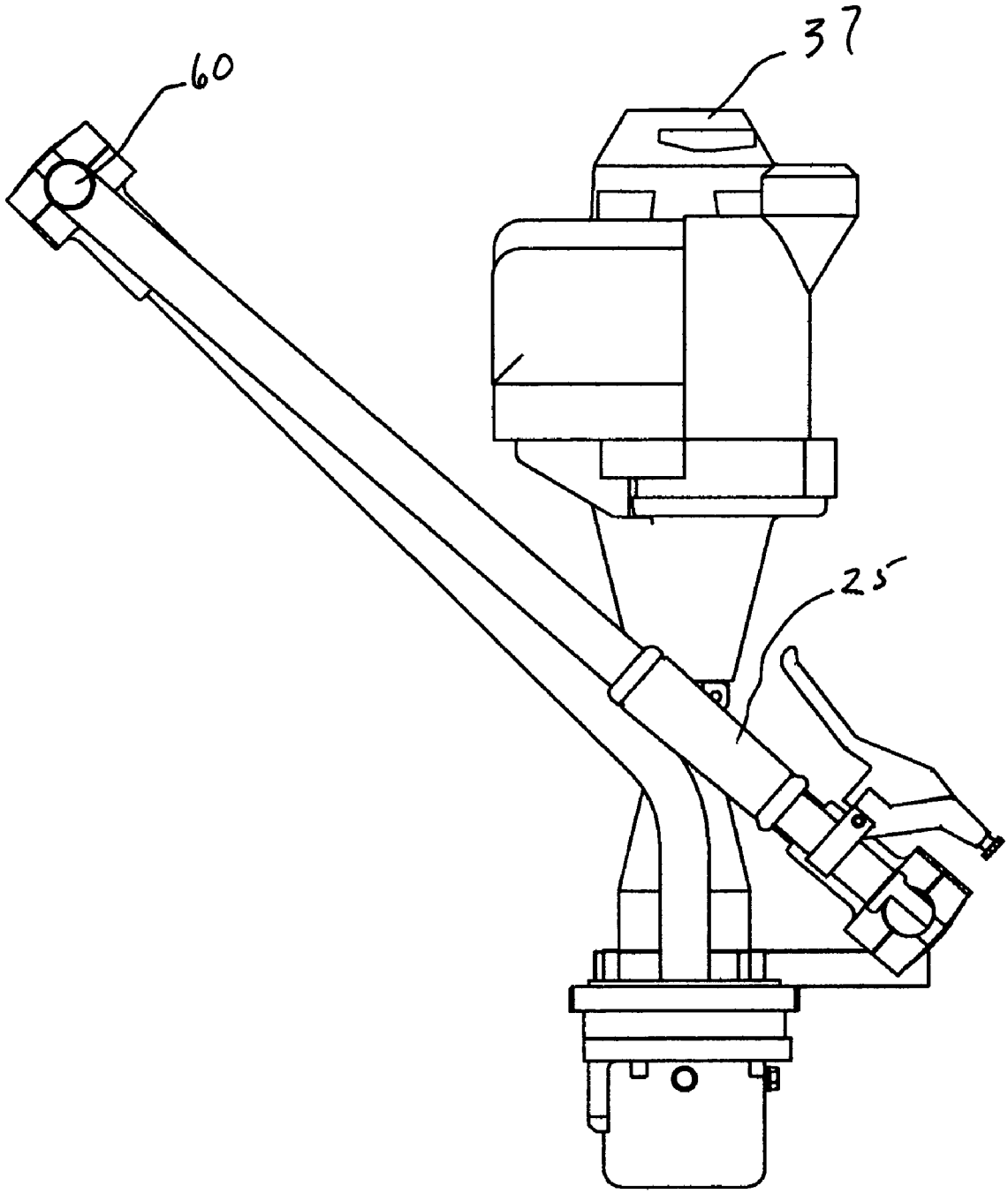

FIG. 33 is a side view of the "power platform assembly" with the "collapsible handle bars" in their unique folded position.

Figure 34:
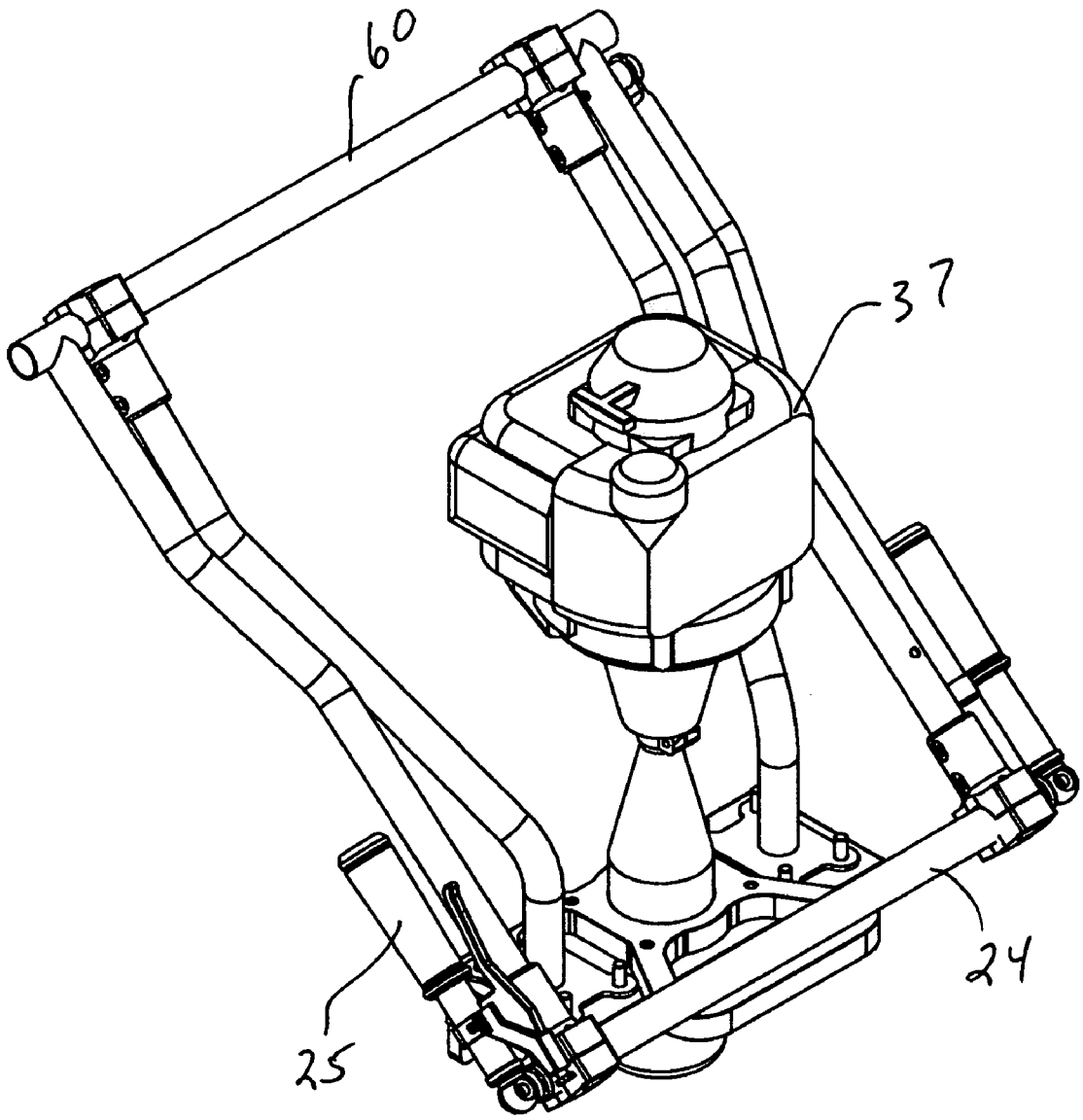

FIG. 34 is an isometric view of the "power platform assembly" with the "collapsible handle bars" folded.

DETAIL DESCRIPTION OF THE INVENTION

FIG. 24 illustrates a vibrating screed in accordance with the present invention and generally comprising an elongated surfacing blade 40, a tubular handle bar assembly 36 extending upwardly and rearwardly from the blade 40, and a motor 37 for imparting vibratory movement to the blade 40 such that, when the blade 40 is displaced over a wet concrete surface, it surfaces, i.e. smoothes, the concrete surface. The motor 37 may be powered by gasoline or other fuels and may also by electric.

More particularly, the tubular handle bar assembly 36 comprises a pair of handle grip tubes 25 adjustably connected to an upper cross bar 24. The cross bar 24 extends between and is fixed to a pair of handle bar mid-sections 23 by an upper handle bar clamp assembly illustrated in FIG. 18. The clamp assembly is comprised of a handle clamp base 28 and a handle clamp top 29. The handle bar mid-sections 23 extend downwards and are rotatably attached to a lower crossbar 60. Base tubes 26 and 27 terminate in attachment plates 65 which are connected to a power platform assembly, shown in FIG. 8, by headless bolts 70 with nuts at their opposed ends or by standard nut and bolts.

The power platform assembly 35, FIGS. 23 and 10, comprises a motor mount assembly, FIG. 8, wherein a motor 37 is connected to the upper end of the motor mount body 16 as shown in FIG. 23. Motor 37 is coupled the drive connector 15 by drive shaft 21. Drive connector 15 rotates within the nylon bearing spacer 19 thereby rotating drive joint 14. Motor mount body 16 is attached to the power platform plate 20 by standard nuts and bolts. Handle flange 17 is an integral part of the motor mount assembly contributes to the ease of lifting and carrying the screed. Flex joint 38 is received by the power platform assembly to rotate the vibrator cartridge assembly.

Figure 1:
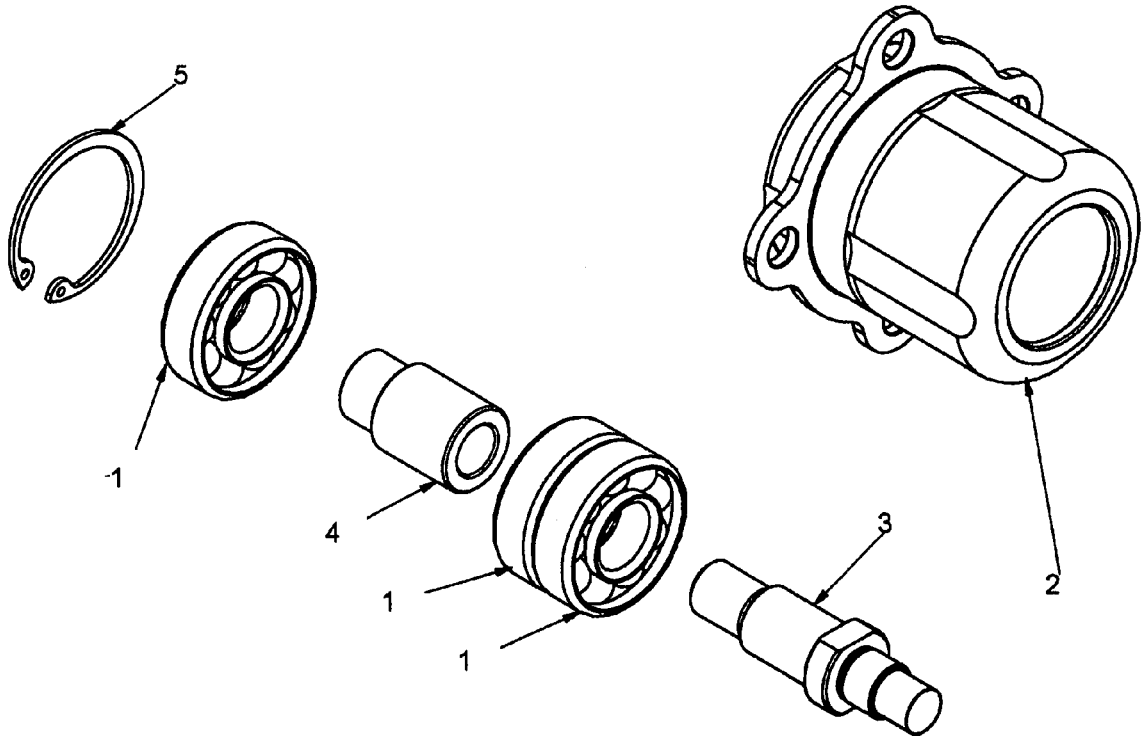
FIG. 1 is the exploded view of the "vibrator bearing cartridge assembly".
Figure 2:
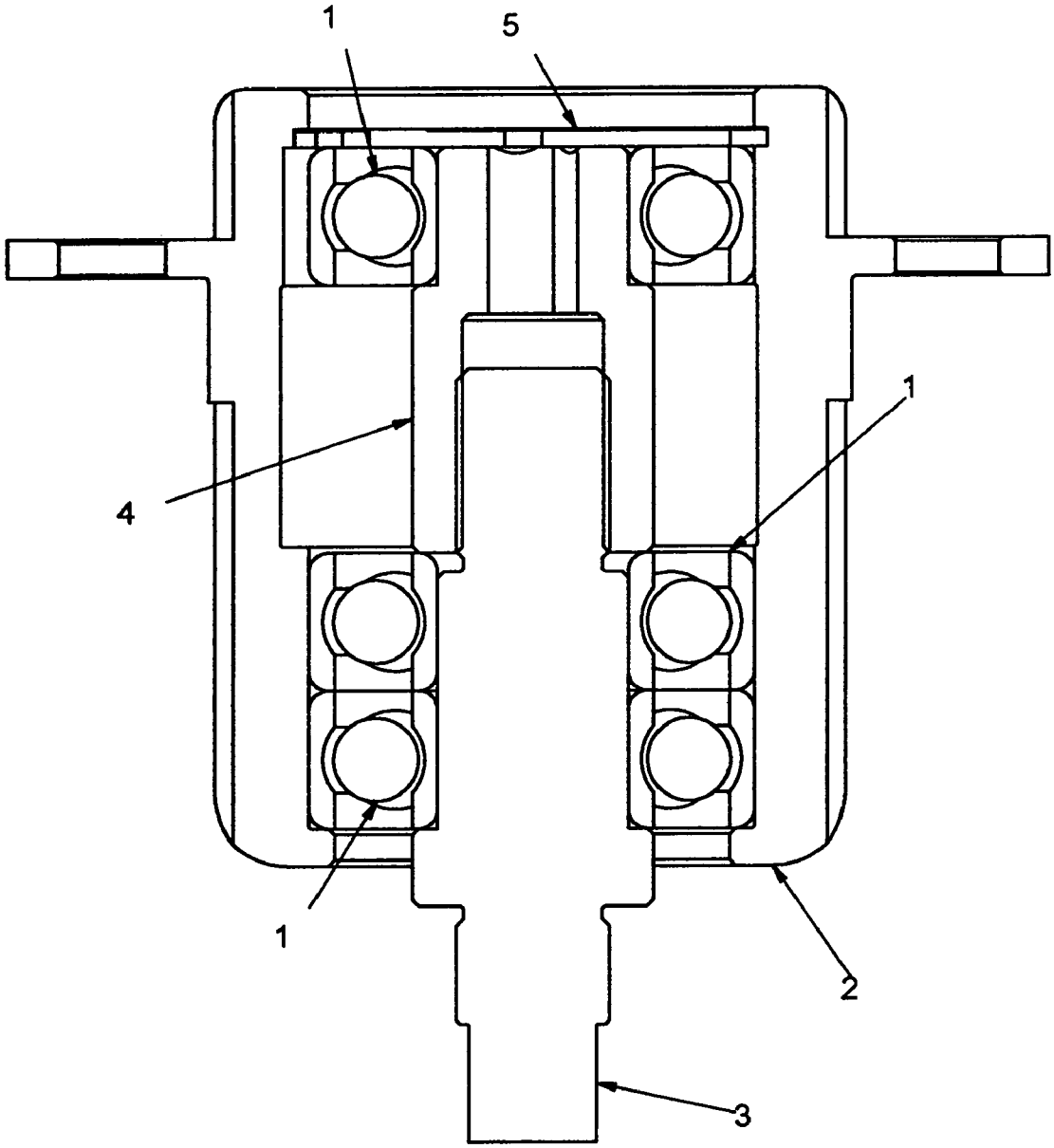
FIG. 2 is a cross-section view of the "vibrator bearing cartridge assembly".

The vibrator cartridge assembly, shown in FIGS. 1, 2 and 3, removably coupled to the flex joint 38 at one end to the vibrator drive joint 4. Drive joint 4 rotates upon bearings 1 and within bearing housing 2.

Vibrator drive shaft 3 is connected at one end to drive joint 4 and to a set of adjustable eccentric weights 11 and fixed eccentric weights 12 at the other as shown in FIG. 6. Bearings 1 are contained within the vibrator cartridge by retaining ring 5. The weights 11 and 12 and vibration cartridge assembly are contained within the eccentric cover 9 that is held in place by bolts secured the eccentric cover mount 13. The cover mount is secured to the vibration cartridge assembly and the blade adapter bracket assembly 8 by standard bolts and nuts. Sealing ring 39 prevents concrete, dirt and other foreign materials from accessing the vibration cartridge assembly or the power platform assembly.

The blade adapter bracket assembly 34 shown in FIGS. 5, 6, 7 and 23, attaches to the power platform assembly 35 separated by vibrational isolators 7. The adapter bracket 8 attaches directly to a screed blade 40 as shown in FIGS. 25 and 26 through bolt holes 49. Blade 40 is generally L shaped on cross sectional view, illustrated in FIG. 26, having a top surface 43, a finishing surface 45 a cutting edge-46 and a trailing edge 41. Structural gussets 42 extent the length of the blade providing more uniform transmission of vibrational energy. Adapters 51 may be employed as shown in FIGS. 27–32 to connect bracket 8 to different shaped screed blades 50.

Accordingly, when in operation, an operator may adjust the height and angle of the handle grip tube 25 to any position for the operators comfort. Grip tube 25 adjustment is accomplished by loosening the bolts securing handle clamp base and top 28, 29 thereby allowing the upper cross bar 24 to be rotated in a plane vertical to the ground thus adjusting the grip tube to any operators height. The bolts are then tightened, forcing the clamp base and top to engage the upper cross bar 24 through friction, ribs or grooves in the upper cross bar. By loosening the retaining bolt extending through the fixed handle knuckle 32 and the adjustable handle knuckle 33, as shown in FIG. 19, lateral adjustment of grip tube 25 is accomplished. As shown in FIG. 20, locking pins 30 located on the fixed handle knuckle 32 are inserted into corresponding adjustment holes located on the adjustable handle knuckle 33 thereby preventing the grip tube from loosing its adjustment even after lengthy periods of vibration.

The operator has complete control over the height of the handle bar mid section 23 through adjustment of the lower clamping area as illustrated in FIGS. 16 and 17. Adjustment is accomplished by loosening the bolts securing handle clamp base and top 28, 29 thereby allowing the lower cross bar 60 to rotate in a plane perpendicular the to base tube 26 and 27 thus adjusting the handle bar mid section to any operators height. The bolts are then tightened, forcing the clamp base and top to engage the lower cross bar 60 through friction, ribs or grooves in the lower cross bar.

The motor 37 causes motor drive shaft 21 to rotate. Shaft 21 being releasably coupled to motor 37 a clamp. Drive shaft 21 causes drive joint 14 and drive connector 15 to rotate as shaft 21 is fixed to connector 15. This rotation is transferred from the power platform assembly to the vibration cartridge through flex joint 38. The flex joint in turn rotatably drives the vibrator drive shaft 3 causing a rotation of the adjustable eccentric weight 11 and the fixed eccentric 12 which, due to its eccentricity, imparts vibration to the blade adapter assembly 34 and thus to the blade 40. The vibration isolators 7 reduce the amount of vibrations transmitted to the handle bar assembly 36 and the operator.

The speed and intensity of the vibrations are controlled by the throttle hand grip attached to the handle grip tube 25. The action of the throttle control is transmitted to the motor 37 through a cable attached to the handle bar assembly by clips.

The vibrational force is transmitted through the blade adapter 8 and along the blade 40 where structural gussets 42 strengthen blade 40 and apply the vibrational force evenly across the wet concrete.

In the event the bearing cartridge 6 should fail, the operator removes the blade adapter assembly 34 to access the bolts attaching the bearing cartridge 6 to the blade adapter 8. The bearing cartridge 6 is replaced and the blade adapter assembly reattached to the power platform assembly.

A kick stand 31 is pivotally attached along the mid point of the handle bar assembly 36 and rotates to directly support the distal end of the screed on the ground. The kick stand is held in place by a clip located on the upper end of the handle bar assembly.

The screed can be folded into a compact form for transportation to and from a work site or for storage. The bolts securing handle clamp base and top 28, 29 thereby allowing the upper cross bar 24 to be rotated in a plane vertical to the ground. The upper cross bar is then rotated such that the grip tubes 25 are parallel to handle bar mid section 23 as shown in FIG. 34. The bolts are then tightened, forcing the clamp base and top to engage the upper cross bar 24 through friction, ribs or grooves in the upper cross bar. The retaining bolt extending through the fixed handle knuckle 32 and the adjustable handle knuckle 33 is loosened, as shown in FIG. 19, allowing the lateral adjustment of grip tube 25. Grip tubes 25 are rotated inward and placed in their shipping/storage position FIG. 34. As shown in FIG. 20, locking pins 30 located on the fixed handle knuckle 32 are inserted into corresponding adjustment holes located on the adjustable handle knuckle 33 thereby locking the grip tube into position. The bolts securing the clamp base and top of the lower clamping area, as illustrated in FIGS. 16 and 17, are loosened.

Final adjustment of the handle bar assembly 36 for storage/shipping is accomplished by lifting the handle bar mid-section thus rotating the lower cross bar 60. The upper cross bar 24 is brought over motor 37 and placed near the handle bar assembly 36. The bolts securing the clamp base and top of the lower clamping area are then tightened, forcing the clamp base and top to engage the lower cross bar 60 through friction, ribs or grooves in the lower cross bar.

Referring to FIGS. 27 and 28, an alternative embodiment is shown where the blade adapter assembly 34 is attached to a Multi-Quip style screed blade 50MQ by adapter components 51MQ.

Referring to FIGS. 29 and 30, an alternative embodiment is shown where the blade adapter assembly 34 is attached to a Vibra-Strike style screed blade 50L by adapter components 51L.

Referring to FIGS. 31 and 32, an alternative embodiment is shown where the blade adapter assembly 34 is attached to a Weber style screed blade 50W by adapter components 51W.

ISKCO Screed Parts List

| item # | Description |
|---|---|
| 1 | Bearing |
| 2 | Bearing Housing |
| 3 | Vibrator Drive Shaft |
| 4 | Vibrator drive Joint |
| 5 | Retaining ring |
| 6 | Bearing cartridge |
| 7 | Vibration isolator |
| 8 | Blade adapter |
| 9 | Eccentric cover |
| 10 | O-ring |
| 11 | Adjustable eccentric |
| 12 | Fixed eccentric |
| 13 | Eccentric cover mount |
| 14 | Drive joint |

-continued

| ISKCO Screed Parts List | |
|---|---|
| item # | Description |
| 15 | Drive connector |
| 16 | Motor mount body |
| 17 | Handle flange |
| 18 | Retaining ring |
| 19 | Nylon bearing spacer |
| 20 | Power platform plate |
| 21 | Motor drive shaft |
| 22 | Bearing |
| 23 | Handle bar mid-section |
| 24 | Upper cross bar |
| 25 | Handle grip tube |
| 26 | Base tube (Right) |
| 27 | Base tube (Left) |
| 28 | Handle clamp base |
| 29 | Handle clamp top |
| 30 | Locking pin |
| 31 | Kickstand |
| 32 | Handle knuckle (fixed) |
| 33 | Handle knuckle (adjustable) |
| 34 | Blade adapter assembly |
| 35 | Power platform assembly |
| 36 | Handle bar assembly |
| 37 | Motor |
| 38 | Flex joint |
| 39 | Sealing ring |
| 40 | Screed blade |
| 41~48 | Screed blade features |
| 41 | Blade radius trailing edge |
| 42 | Structural gusset |
| 43 | Blade top surface |
| 44 | disregard |
| 45 | Finishing surface |
| 46 | Cutting edge |
| 47 | disregard |
| 48 | Structural radius |
| 49 | Mounting holes |
| 50-MQ | Screed blade - Multi-Quip |
| 51-MQ | Multi-Quip adapter components |
| 50-L | Screed blade - Lindley |
| 51-L | Lindley adapter components |
| 50-W | Screed blade - Weber |
| 51-W | Weber adapter components |

I claim:

1. A portable vibratory concrete screed comprising:

a screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to a vibrator cartridge assembly, wherein the means for attaching the power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, the vibrator cartridge assembly attached to the blade adapter assembly, the vibrator cartridge assembly also being attached to the power platform assembly, wherein the power platform assembly operates the screed blade and imparts vibration onto the screed blade, and a plurality of vibration isolators, the plurality of vibration isolators separating the blade adapter assembly from the power platform assembly.

2. A portable vibratory concrete screed comprising:

a screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to a vibrator cartridge assembly, wherein the means for attaching the power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly wherein the power platform assembly operates the screed blade and imparts vibration onto the screed blade, and a plurality of vibration isolators, the plurality of vibration isolators separating the blade adapter assembly from the power platform assembly.

3. A portable vibratory concrete screed comprising:

a screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to the vibrator cartridge assembly, wherein the means for attaching a power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly, a sealing ring, the sealing ring being used to prevent foreign objects from entering in the vibrator cartridge assembly or the power platform assembly, wherein the power platform assembly operates the screed blade and imparts vibration onto the screed blade, and a plurality of vibration isolators, the plurality of vibration isolators separating the blade adapter assembly from the power platform assembly.

4. A portable vibratory concrete screed comprising:

a screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to the vibrator cartridge assembly, wherein the means for attaching a power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, wherein the handle bar assembly further comprises:

an upper cross bar having two ends, a first end and a second end, a pair of handle bar grips comprising a first handle bar grip and a second handle bar grip, the first handle bar grip being connected to the first end of the upper cross bar, the second handle bar grip being connected to the second end of the upper cross bar, a pair of handle bar mid-sections comprising a first handle bar mid-section and a second handle bar mid-section, each of the handle bar mid-sections having two ends, a top end and a bottom end, the top end of the first handle bar mid-section being connected to the first end of the upper cross bar, the top end of the second handle bar mid-section being connected to the second end of the upper cross bar, a lower crossbar having two ends, a first end and a second end, the first end of the lower crossbar being connected to the bottom end of the first handle bar mid-section, the second end of the lower crossbar being connected to the bottom end of the second handle bar mid-section, a pair of base tubes comprising a first base and a second base tube, each of the base tubes having two ends, a top end and a bottom end, the top end of the first base tube being connected to the first end of the lower crossbar, the top end of the second base tube being connected to the second end of the lower crossbar, a pair of attachment plates comprising a first attachment plate and a second attachment plate, the first attachment plate being connected to the second end of the first base tube, the second attachment plate being connected to the second end of the second base tube, means for attaching each attachment plate to the power platform assembly, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly, a sealing ring, the sealing ring being used to prevent foreign objects from entering in the vibrator cartridge assembly or the power platform assembly, wherein the power platform assembly operates the screed blade and imparts vibration onto the screed blade, and a plurality of vibration isolators, the plurality of vibration isolators separating the blade adapter assembly from the power platform assembly.

5. A portable vibratory concrete screed comprising:

a screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to the vibrator cartridge assembly, wherein the means for attaching a power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, wherein the handle bar assembly further comprises:

a pair of fixed hand knuckles comprising a first fixed hand knuckle and a second fixed hand knuckle, the first fixed hand knuckle being located on the first handle bar grip, the second fixed hand knuckle being located on the second handle bar grip, a pair of adjustable hand knuckles comprising a first adjustable hand knuckle and a second adjustable hand knuckle, the first adjustable hand knuckle being located on the first end of the upper cross bar, the second adjustable hand knuckle being located on the second end of the upper cross bar, each adjustable hand knuckle further comprising a plurality of adjustment holes, a plurality of locking pins, wherein at least two locking pins are attached to each fixed hand knuckles, a pair of handle clamp tops comprising a first handle clamp top and a second handle clamp top, a pair of handle clamp bases comprising a first handle clamp base and a second handle clamp base, wherein the locking pins on the first fixed hand knuckle are inserted through holes located on the first adjustable handle knuckle, and further wherein the locking pins on the second fixed hand knuckle are inserted through holes located on the second adjustable handle knuckle, further wherein the first handle clamp top and the first handle clamp base are adjustably attached to the first fixed hand knuckle and the first adjustable hand knuckle after the first fixed hand knuckle and the first adjustable hand knuckle have been placed in contact with each other, further wherein the second handle clamp top and the second handle clamp base are adjustably attached to the second fixed hand knuckle and the second adjustable hand knuckle after the second fixed hand knuckle and the second adjustable hand knuckle have been placed in contact with each other, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly, a sealing ring, the sealing ring being used to prevent foreign objects from entering in the vibrator cartridge assembly or the power platform assembly, wherein the power platform assembly operates the screed blade and imparts vibration onto the screed blade, and a plurality of vibration isolators, the plurality of vibration isolators separating the blade adapter assembly from the power platform assembly.

6. A portable vibratory concrete screed comprising:

a screed blade, wherein the screed blade further comprises:

an upper portion, a lower portion attached to the upper portion, the lower portion including a top surface, the lower portion also including a finishing surface, the lower portion also including a cutting edge, the lower portion also including a trailing edge, a plurality of gussets located on the top surface of the screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to the vibrator cartridge assembly, wherein the means for attaching a power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, wherein the handle bar assembly further comprises:

an upper cross bar having two ends, a first end and a second end, a pair of handle bar grips comprising a first handle bar grip and a second handle bar grip, the first handle bar grip being connected to the first end of the upper cross bar, the second handle bar grip being connected to the second end of the upper cross bar, a pair of handle bar mid-sections comprising a first handle bar mid-section and a second handle bar mid-section, each of the handle bar mid-sections having two ends, a top end and a bottom end, the top end of the first handle bar mid-section being connected to the first end of the upper cross bar, the top end of the second handle bar mid-section being connected to the second end of the upper cross bar, a lower crossbar having two ends, a first end and a second end, the first end of the lower crossbar being connected to the bottom end of the first handle bar mid-section, the second end of the lower crossbar being connected to the bottom end of the second handle bar mid-section, a pair of base tubes comprising a first base and a second base tube, each of the base tubes having two ends, a top end and a bottom end, the top end of the first base tube being connected to the first end of the lower crossbar, the top end of the second base tube being connected to the second end of the lower crossbar, a pair of attachment plates comprising a first attachment plate and a second attachment plate, the first attachment plate being connected to the second end of the first base tube, the second attachment plate being connected to the second end of the second base tube, means for attaching each attachment plate to the power platform assembly, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly, a sealing ring, the sealing ring being used to prevent foreign objects from entering in the vibrator cartridge assembly or the power platform assembly, wherein the power platform assembly operates the screed blade and imparts vibration onto the screed blade, and a plurality of vibration isolators, the plurality of vibration isolators separating the blade adapter assembly from the power platform assembly.

7. A portable vibratory concrete screed comprising:

a screed blade, wherein the screed blade comprises a Multi-Quip style screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to the vibrator cartridge assembly, wherein the means for attaching a power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, wherein the handle bar assembly further comprises:

an upper cross bar having two ends, a first end and a second end, a pair of handle bar grips comprising a first handle bar grip and a second handle bar grip, the first handle bar grip being connected to the first end of the upper cross bar, the second handle bar grip being connected to the second end of the upper cross bar, a pair of handle bar mid-sections comprising a first handle bar mid-section and a second handle bar mid-section, each of the handle bar mid-sections having two ends, a top end and a bottom end, the top end of the first handle bar mid-section being connected to the first end of the upper cross bar, the top end of the second handle bar mid-section being connected to the second end of the upper cross bar, a lower crossbar having two ends, a first end and a second end, the first end of the lower crossbar being connected to the bottom end of the first handle bar mid-section, the second end of the lower crossbar being connected to the bottom end of the second handle bar mid-section, a pair of base tubes comprising a first base and a second base tube, each of the base tubes having two ends, a top end and a bottom end, the top end of the first base tube being connected to the first end of the lower crossbar, the top end of the second base tube being connected to the second end of the lower crossbar, a pair of attachment plates comprising a first attachment plate and a second attachment plate, the first attachment plate being connected to the second end of the first base tube, the second attachment plate being connected to the second end of the second base tube, means for attaching each attachment plate to the power platform assembly, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly, a sealing ring, the sealing ring being used to prevent foreign objects from entering in the vibrator cartridge assembly or the power platform assembly, wherein the power platform assembly operates the screed blade and imparts vibration onto the screed blade, and a plurality of vibration isolators, the plurality of vibration isolators separating the blade adapter assembly from the power platform assembly.

8. A portable vibratory concrete screed comprising:

a screed blade, wherein the screed blade comprises a Vibra-Strike style screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to the vibrator cartridge assembly, wherein the means for attaching a power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, wherein the handle bar assembly further comprises:

an upper cross bar having two ends, a first end and a second end, a pair of handle bar grips comprising a first handle bar grip and a second handle bar grip, the first handle bar grip being connected to the first end of the upper cross bar, the second handle bar grip being connected to the second end of the upper cross bar, a pair of handle bar mid-sections comprising a first handle bar mid-section and a second handle bar mid-section, each of the handle bar mid-sections having two ends, a top end and a bottom end, the top end of the first handle bar mid-section being connected to the first end of the upper cross bar, the top end of the second handle bar mid-section being connected to the second end of the upper cross bar, a lower crossbar having two ends, a first end and a second end, the first end of the lower crossbar being connected to the bottom end of the first handle bar mid-section, the second end of the lower crossbar being connected to the bottom end of the second handle bar mid-section, a pair of base tubes comprising a first base and a second base tube, each of the base tubes having two ends, a top end and a bottom end, the top end of the first base tube being connected to the first end of the lower crossbar the top end of the second base tube being connected to the second end of the lower crossbar, a pair of attachment plates comprising a first attachment plate and a second attachment plate, the first attachment plate being connected to the second end of the first base tube, the second attachment plate being connected to the second end of the second base tube, means for attaching each attachment plate to the power platform assembly, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly, a sealing ring, the sealing ring being used to prevent foreign objects from entering in the vibrator cartridge assembly or the power platform assembly, wherein the power platform assembly operates the screed blade and imparts vibration onto the screed blade, and a plurality of vibration isolators, the plurality of vibration isolators separating the blade adapter assembly from the power platform assembly.

9. A portable vibratory concrete screed comprising:

a screed blade, wherein the screed blade comprises a Weber style screed blade, a blade adapter assembly attached to the screed blade, the blade adapter assembly further comprises:

a flat plate having two surfaces, a top surface and a bottom surface, an adapter bracket attached to the bottom surface of the flat plate, wherein the screed blade is attached to the adapter bracket, a power platform assembly attached to the blade adapter assembly, the power platform assembly further comprises:

a motor, a motor mount body having two ends comprising an upper end and a lower end, the lower end of the motor mount body being attached to the motor, a drive shaft located within the motor mount body, a drive connector connected to the drive shaft, a drive joint connected to the drive connector, means for attaching the power platform assembly to the vibrator cartridge assembly, wherein the means for attaching a power platform assembly to the vibrator cartridge assembly further comprises a flex joint, the flex joint being connected to the drive joint within the power platform assembly, the flex joint also being connected to the vibrator cartridge assembly, an adjustable handle bar assembly attached to the power platform assembly, wherein the handle bar assembly further comprises:

an upper cross bar having two ends, a first end and a second end, a pair of handle bar grips comprising a first handle bar grip and a second handle bar grip, the first handle bar grip being connected to the first end of the upper cross bar, the second handle bar grip being connected to the second end of the upper cross bar, a pair of handle bar mid-sections comprising a first handle bar mid-section and a second handle bar mid-section, each of the handle bar mid-sections having two ends, a top end and a bottom end, the top end of the first handle bar mid-section being connected to the first end of the upper cross bar, the top end of the second handle bar mid-section being connected to the second end of the upper cross bar, a lower crossbar having two ends, a first end and a second end, the first end of the lower crossbar being connected to the bottom end of the first handle bar mid-section, the second end of the lower crossbar being connected to the bottom end of the second handle bar mid-section, a pair of base tubes comprising a first base and a second base tube, each of the base tubes having two ends, a top end and a bottom end, the top end of the first base tube being connected to the first end of the lower crossbar, the top end of the second base tube being connected to the second end of the lower crossbar, a pair of attachment plates comprising a first attachment plate and a second attachment plate, the first attachment plate being connected to the second end of the first base tube, the second attachment plate being connected to the second end of the second base tube, means for attaching each attachment plate to the power platform assembly, the vibrator cartridge assembly attached to the blade adapter assembly, the vibrator cartridge assembly also being attached to the power platform assembly, the vibrator cartridge assembly further comprises:

a bearing housing, a plurality of bearings located within the bearing housing, a drive joint located within the bearing housing, the drive joint rotating upon the plurality of bearings, a vibrator drive shaft having two ends, a first end and a second end, wherein the first end of the vibrator drive shaft is attached to the drive joint, a plurality of adjustable eccentric weights attached to the second end of the vibrator drive shaft, a plurality of fixed eccentric weights attached to the second end of the vibrator drive shaft, an eccentric cover that covers the bearing housing, the eccentric cover further covering the drive joint, the eccentric cover further covering the vibrator drive shaft, the eccentric cover further covering the plurality of adjustable eccentric weights, the eccentric cover further covering the plurality of fixed eccentric weight, an eccentric cover mount that is attached to the eccentric cover, the eccentric cover mount also being connected to the power platform assembly, a sealing ring, the sealing ring being used to prevent foreign objects from entering in the vibrator cartridge assembly or the power platform assembly, wherein the power platform assembly operates the screed blade and imparts vibration onto the screed blade, and a plurality of vibration isolators, the plurality of vibration isolators separating the blade adapter assembly from the power platform assembly.

* * * * *